US005502477A

United States Patent [19]

Osada et al.

[11] Patent Number: 5,502,477

[45] Date of Patent: Mar. 26, 1996

[54] THERMAL TRANSFER TYPE COLOR PRINTER

[75] Inventors: Naomi Osada, Yokohama; Toshiro Kohno; Satoshi Kanbe, both of Yokosuka, all of Japan

[73] Assignee: Victor Company of Japan, Ltd., Yokohoma, Japan

[21] Appl. No.: 67,833

[22] Filed: May 27, 1993

[30] Foreign Application Priority Data

| | | | |
|---|---|---|---|
| May 29, 1992 | [JP] | Japan | 4-163575 |
| Jun. 30, 1992 | [JP] | Japan | 4-195959 |
| Apr. 22, 1993 | [JP] | Japan | 5-118961 |

[51] Int. Cl.[6] ..... B41J 2/325

[52] U.S. Cl. ..... 347/176; 347/218; 400/645; 400/120.04

[58] Field of Search ..... 346/136, 76 PH; 400/645, 583, 611, 613.1, 614, 614.1, 617, 618, 185, 186, 120.02, 120.04, 634, 636, 636.2; 347/176, 174, 172, 218

[56] References Cited

U.S. PATENT DOCUMENTS 4,717,270 1/1988 Tsutsumi ..... 346/76 PH

FOREIGN PATENT DOCUMENTS 2286273 11/1990 Japan .

4344261 11/1992 Japan .

*Primary Examiner*—Huan H. Tran

*Attorney, Agent, or Firm*—Pollock, Vande Sande & Priddy

[57] ABSTRACT

A color printer for recording an image having at least two colors on a recording sheet with a recording head being brought into contact with a platen roller in a state that the recording sheet is interposed therebetween, the two colors being successively printed on a surface of the recording sheet with the recording sheet being operated to reciprocate with respect to a recording position on the platen roller. The printer includes a clamping device provided at a downstream side of the recording head in a sheet-travelling path from a supply section of the recording sheet to a discharging section of the recording sheet for holding the recording sheet when recording the image. The clamping device is fixed with respect to the recording position so that a distance between a holding position of the recording sheet taken by the clamping device and the recording position on the platen roller is always constant during the image recording. This arrangement can make easy the positioning of the recording sheet in the recording process to provide a high-quality image on the recording sheet. Also included is a reversing device provided at an upstream side of the recording head in the sheet-travelling path for moving the recording sheet toward an upstream side in the sheet-travelling path before the image recording. Thus, it is possible to remove the looseness of the recording sheet between the clamping device and the platen roller.

11 Claims, 33 Drawing Sheets

12

THERMAL TRANSFER TYPE COLOR PRINTER

BACKGROUND OF THE INVENTION

The present invention relates to a thermal transfer type color printer with a line thermal head.

Various types of printers are known which melt or sublimate color inks on a surface of a transfer sheet by a thermal head to successively apply the color inks to a recording sheet to print a color image thereon. FIG. 1 shows one of such conventional printers which comprises a clamper 303 for holding a front end portion of a recording sheet 301, a platen roller 302 for winding the recording sheet 301 held by the clamper 303, a pair of rollers 305, 306 for winding front and rear sides of the transfer sheet 304, and a thermal head 308 supported by a shaft 307 to be pressed against the platen roller 302 with a transfer sheet 304 and the recording sheet 301 being interposed therebetween at the time of the printing mode. The transfer sheet 304 has color inks such as yellow, magenta, cyan and black which are successively applied thereon to be striped in the longitudinal directions. The width of each of the ink-applied stripes substantially corresponds to that of one picture plane. Further, the thermal head 308 has a heating section comprising a plurality of heating elements successively arranged in a line in parallel to the shaft of the platen roller 302. In response to supply of a predetermined current signal, each of the plurality of heating elements heat to simultaneously effect a printing by an amount corresponding to one line.

In printing operation, the recording sheet 301 fed from a sheet-feeding tray, not shown, is held on the platen roller 302 through the clamper 303, and then the platen roller 302 is rotated by a motor, not shown, while a current signal is supplied to the thermal head 308 pressed against the platen roller 302 in the state that the transfer sheet 304 is wound around the take-up side roller 305 by a take-up motor, not shown, thereby transferring the color ink of the transfer sheet 304 onto the recording sheet 301. After completion of the first-color printing operation, the platen roller 302 is rotated at a high speed to feed the recording sheet 301 to the recording start position, while transfer sheet 304 is wound around the take-up side roller 305 so that a portion having the next color ink comes into contact with the recording sheet 301 to again perform the similar printing operation. With such a printing operation being repeatedly effected with respect to the same recording sheet 301, the respective color inks on the transfer sheet 304 are overlapped on the surface of the recording sheet 301 to form a color image thereon. After completion of the printing operations by all the color inks, the thermal head 308 is rotated about the shaft 307 clockwise in the illustration to be separated from the platen roller 302 and the recording sheet 301 printed is discharged into a sheet-discharging tray, not shown, thus terminating the printing operation.

However, this FIG. 1 arrangement has a disadvantage that the diameter of the platen roller 302 becomes large so that the size of the thermal head 308 increases, thereby increasing the cost of the printer.

FIG. 2 shows another conventional printer. In FIG. 2, a recording sheet 301 is pressed against a platen roller 302 by pairs of sheet-feeding rollers 309 and 310 without holding the recording sheet 301 with respect to the platen roller 302. For printing, the recording sheet 301 is reciprocated by the sheet feeding rollers 309 and 310.

According to this FIG. 2 printer, although the diameter of the platen roller 302 is small, difficulty is encountered to accurately set the recording sheet 301 at the recording start position in the reciprocative movement of the recording sheet 301, thus deteriorating the image quality due to positional shift.

Further, FIG. 3 illustrates a conventional printer which mainly includes a clamping unit 320 for clamping one end portion of a recording sheet 301, a carrying mechanism 321 for movably supporting the clamping unit 320 in the left and right directions (generally, in the secondary scanning directions of the recording sheet) in the illustration, and a recording unit 322. The clamping unit 320 comprises a clamper 323, a substantially L-shaped pulley block 324 for conveying the clamper 323, and a solenoid 326 fixedly secured to the pulley block 324. Here, the clamper 323 is rotatably fitted to a shaft 325. References 324*a* and 324*b* are pullies attached to the pulley block 324. The tip portion of the recording unit 322 side of the clamper 323 is bent so as to appropriately clamp the recording sheet 301 and the other end portion thereof has the solenoid 326 which rotates the clamper 323. Further, the carrying mechanism 321 comprises drive pullies 336, 337, a belt 328 stretched between the drive pullies 336 and 337, and others. The belt 328 is disposed at the lower portion of the clamping unit 320 so as to be driven through belts b and c by means of a motor 327 fixed to the recording unit 322. The pulley block 324 is fixedly secured to the belt 328. Further, below the belt 328 there is disposed a stage 329 for allowing the pullies 324*a* and 324*b* fixed to the pulley block 324 to move in the secondary scanning directions of the recording sheet 301. The pullies 324*a* and 324*b* are moved by means of an adequate mechanism, not shown. On the stage 329 there is provided a reflection type positioning sensor 330 which is a detecting means to determine the original point (recording start position) of the pulley block 324. The recording unit 322 drives the motor 327 the power of which is transmitted to the platen roller 302 and the sheet-feeding rollers 309 and 310. These sheet-feeding rollers 309 and 310 guide the recording sheet 301 fed. Here, the feeding roller 309 is urged toward the feeding roller 310 side by means of a mechanism, not shown, to slide on the recording sheet 301. Further, on the feeding roller 310 attached to a fixed shaft there is provided a one-way clutch whereby the recording sheet 301 is movable only in one direction. In the motor 327 there is provided an encoder whereby the motor 327 stops to rotate when counting a predetermined number of pulses. The feeding roller 310 is arranged to be rotatable at a lower speed than the drive pulley 337 by changing the gear ratio so as to prevent the recording sheet 301 from being loosen on the travelling passage. The platen roller 302 is disposed between the carrying mechanism 321 and feeding rollers 309, 310 to receive a pressure applied to the thermal head 308. The thermal head 308 is arranged to be rotatable about a shaft 307 and pressed by rotation of an eccentric cam 331 so that pressure is evenly applied to the heating portion of the thermal head 308. Above the thermal head 308 there are provided a pair of transfer sheet rollers 305 and 306 for winding a transfer sheet 304. An intermediate portion of the transfer sheet 304 wound around the transfer sheet rollers 305 and 306 is disposed between the thermal head 308 and the platen roller 302. Numerals 332 and 333 are guide rollers provided at the front and rear sides of the platen roller 302 for causing the transfer sheet 304 to smoothly travel.

According to the FIG. 3 conventional printer, in the reciprocative movement of the recording sheet 301, the recording sheet 301 can accurately take the recording start position to provide a high-quality image and the diameter of the platen roller 302 can be reduced to allow use of a small-sized thermal head 308 to reduce the cost of the printer. However, this arrangement requires the carrying mechanism 321 for allowing the accurate positioning of the recording sheet 301. The provision of the carrying mechanism 321 increases the size and cost of the printer.

SUMMARY OF THE INVENTION

It is therefore an object of the present invention to provide a printer which is capable of accurately and stably setting the recording sheet at the recording start position with a simple structure and preventing the recording sheet from being loosen concurrently with using a small-diameter platen roller to decrease the cost of the printer.

According to this invention, there is provided a color printer for recording an image having at least two colors on a recording sheet with recording head means being brought into contact with a platen roller in a state that the recording sheet is interposed therebetween, the two colors being successively printed on a surface of the recording sheet with the recording sheet being operated to reciprocate with respect to a recording position on the platen roller. The printer includes clamping means provided at a downstream side of the recording head means in a sheet-travelling path from a supply section of the recording sheet to a discharging section of the recording sheet for holding the recording sheet when recording the image. The clamping means is fixed with respect to the recording position so that a distance between a holding position of the recording sheet taken by the clamping means and the recording position on the platen roller is always constant during the image recording. This arrangement can make easy the positioning of the recording sheet in the recording process to provide a high-quality image on the recording sheet. In addition, it is possible to use a small-sized platen roller to reduce the cost of the color printer.

Preferably, the color printer further includes reversing means provided at an upstream side of the recording head means in the sheet-travelling path for moving the recording sheet toward an upstream side in the sheet-travelling path before the image recording, arresting means provided between the recording head means and the clamping means for temporarily maintaining recording sheet at a given position, and detection means for detecting the recording sheet maintained by the arresting means. Drive means drives the reversing means so that the recording sheet is moved toward the upstream side in the sheet-travelling path until the detection means detects an absence of the recording sheet within the staying means, and for additionally driving the reversing means to cause the recording sheet to move by a predetermined distance. Thus, it is possible to remove the looseness of the recording sheet in the arresting means between the clamping means and the platen roller. In addition, it is possible to accurately take the recording position even if a backlash occurs in the recording sheet conveying mechanism.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
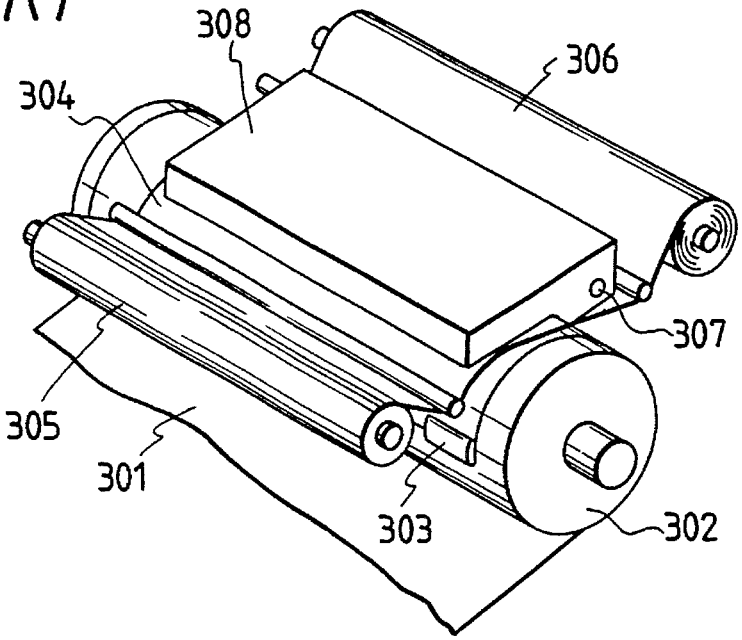
FIG. 1 PRIOR ART
FIG. 1 shows a principal portion of a conventional color printer.
Figure 2:
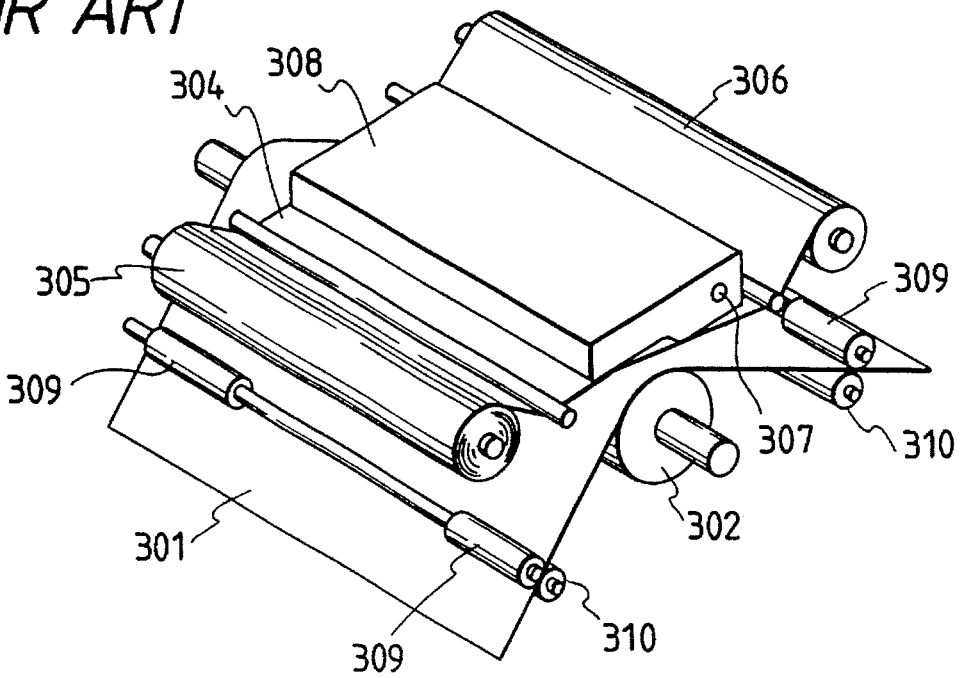
FIG. 2 PRIOR ART
FIG. 2 shows a principal portion of another conventional color printer.
Figure 3:
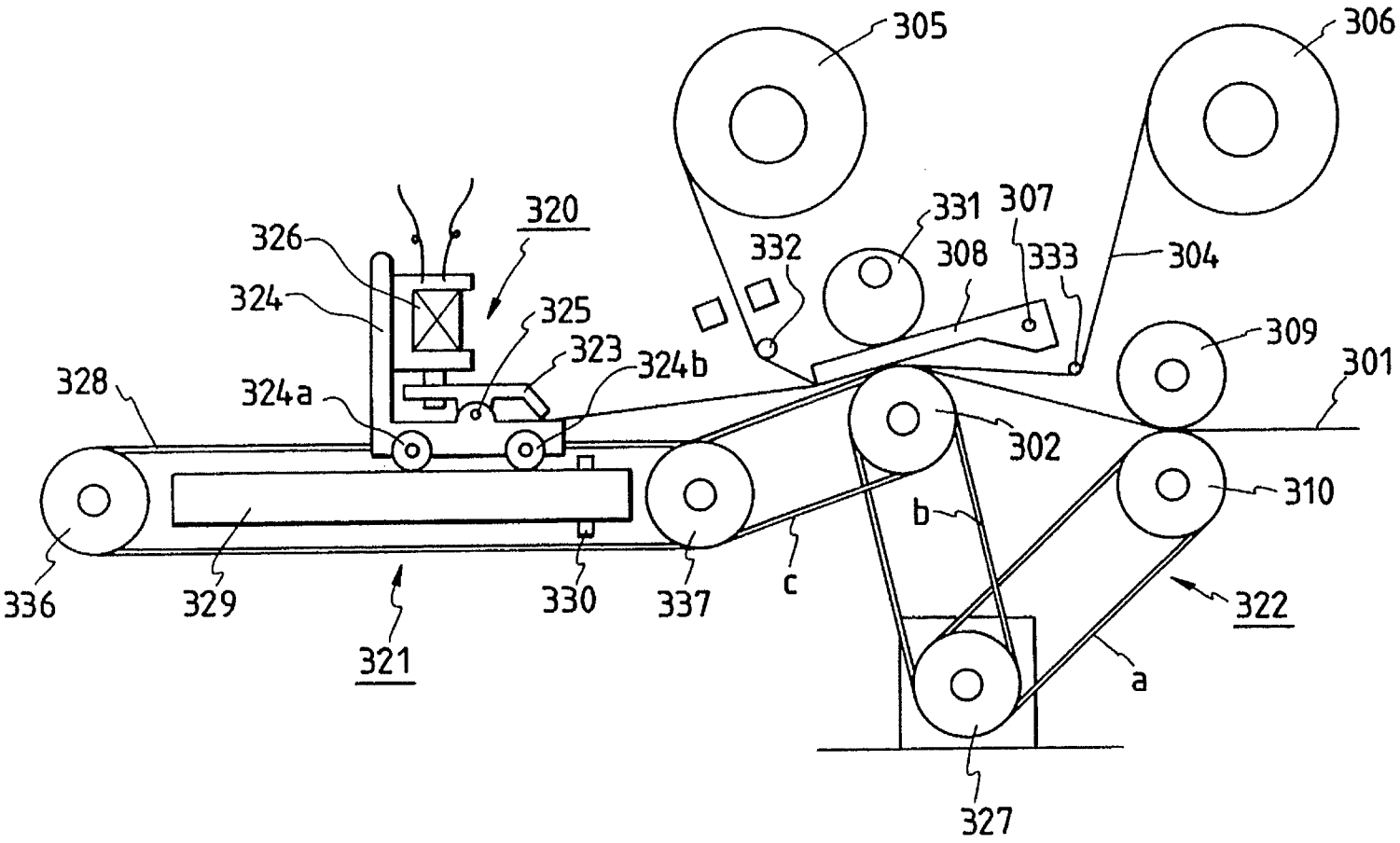
FIG. 3 PRIOR ART
FIG. 3 shows a principal portion of a further conventional color printer.
Figure 4:
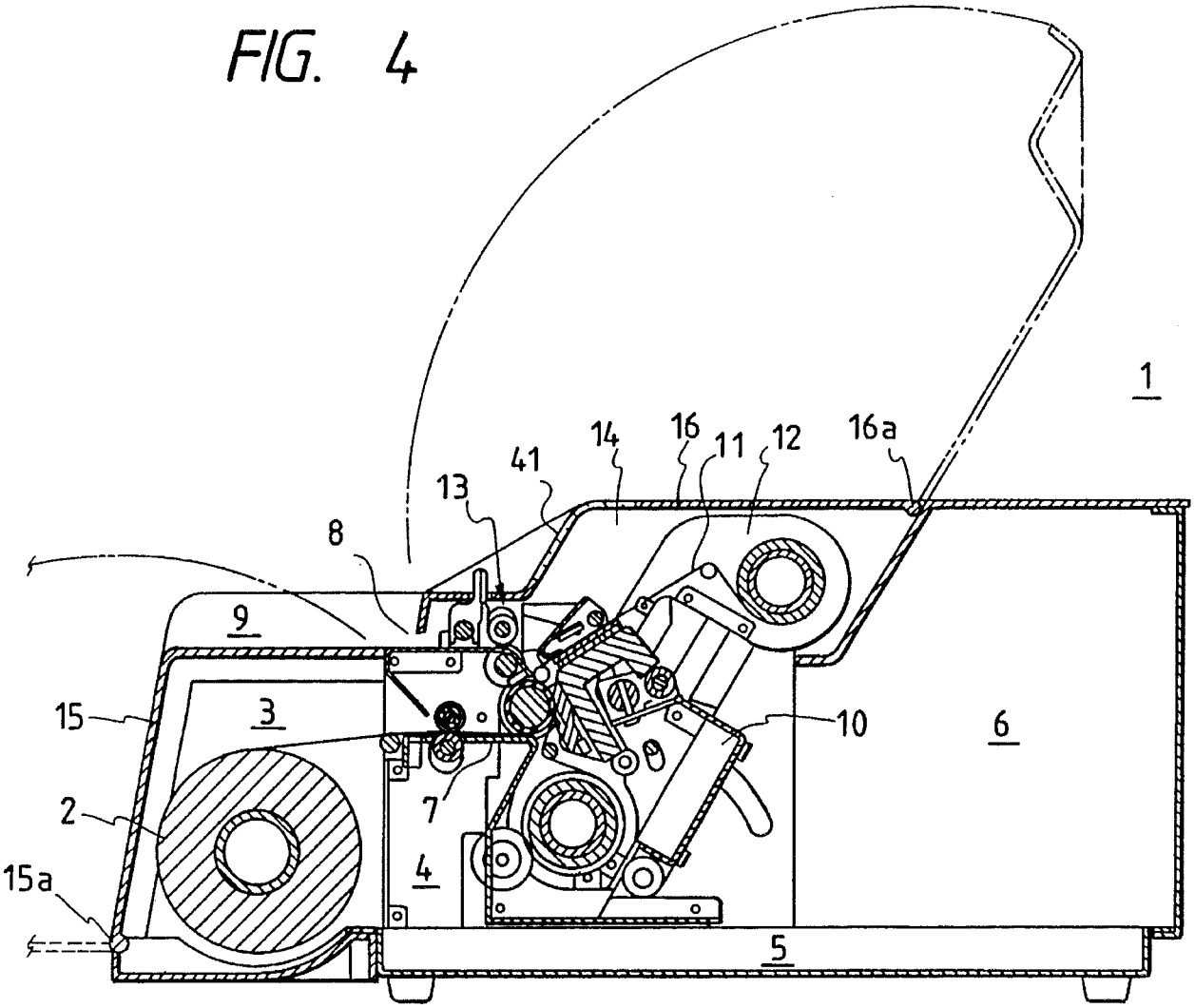
FIG. 4 is a cross-sectional view showing an entire arrangement of a printer according to a first embodiment of this invention.
Figure 5:
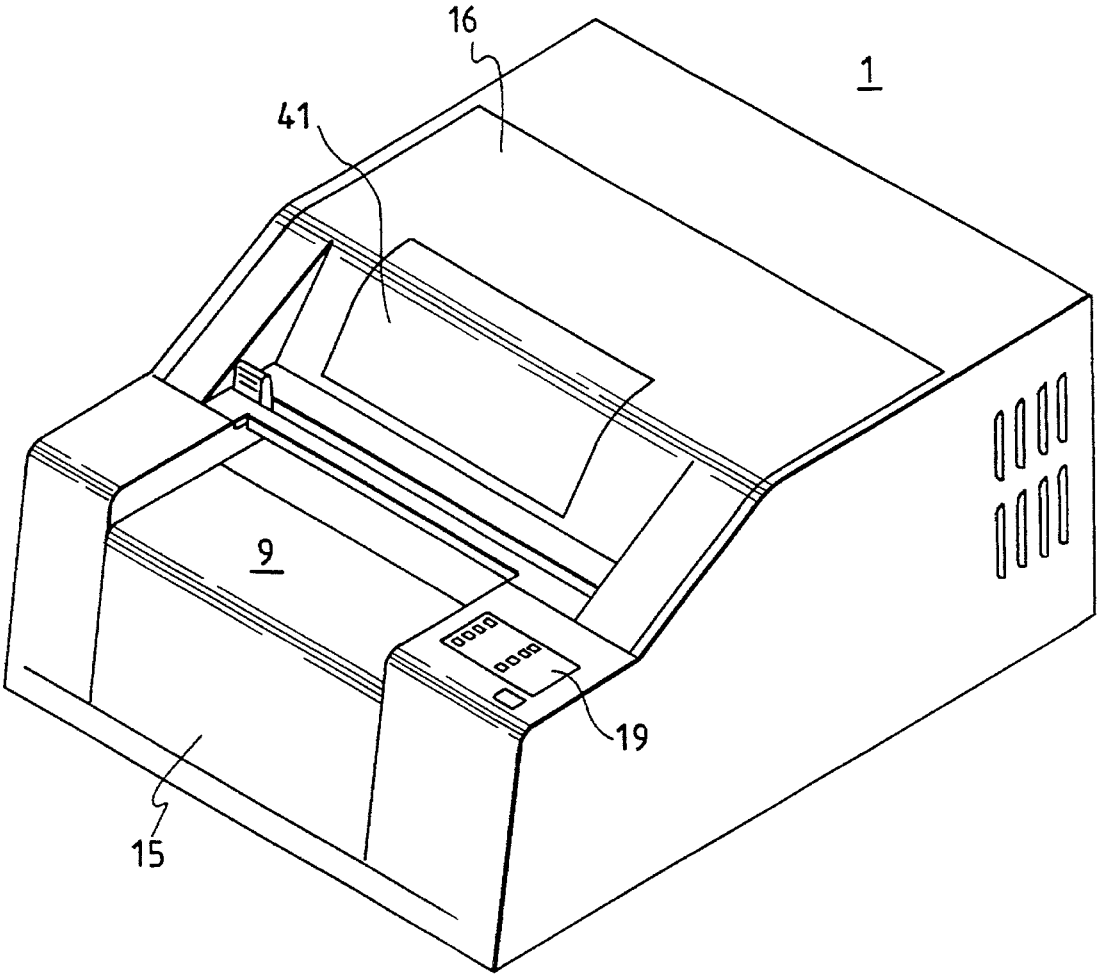
FIG. 5 is a perspective view showing the appearance of the printer according to the first embodiment.

A description will be made hereinbelow in terms of a color printer (which will be referred hereinafter to as a printer) according to a first embodiment of this invention. As illustrated in FIGS. 4 and 5, this printer, designated at numeral 1, substantially has a stepwise configuration and comprises a recording sheet encasing section 3 disposed at its front side for encasing a rolled recording sheet 2, a printing mechanism section 4 placed at its center portion, a signal processing circuit section 5 located at its bottom portion, and a mechanism control section 6 provided at its rear portion. The rolled recording sheet 2 is partially wound around a platen roller 7 of the printing mechanism section 4 and led through a sheet-discharging opening 8 to a sheet-discharging guide section 9 provided at an outside of the printer 1. The printing mechanism section 4 further includes a thermal head mechanism 10, cartridge 12 for holding a transfer sheet 11, a holding mechanism 13 for holding and discharging the recording sheet 2, an arresting section 14 for temporarily arresting the recording sheet 2 in recording, and others. A cover 15 for the recording sheet encasing section 3 and a cover 16 for the cartridge 12 and the arresting section 14 which are portions of a housing of the printer 1 are arranged to be rotatable to be openable and closable for making easy the exchange work of the recording sheet 2 and the cartridge 12 and the removal work of the recording sheet 2 at the time of occurrence of a jam. Further, a portion 41 of the cover 16 is constructed with a transparent member so that the recording sheet 2 in the arresting section 14 can be observed therefrom. Through this transparent member 41, the user can find a defect of the image printed. In FIG. 5, numeral 19 represents a display panel to display an operating state of the printer 1.

In this printer 1, the recording sheet 2 is operated to reciprocate across the platen roller 7 so that the three-color (yellow (Y), magenta (M) and cyan (C)) or four-color (yellow (Y), magenta (M), cyan (C) and black (Bk)) plane-recording operation is affected. Since the recording sheet 2 is not discharged to the outside of the printer 1 until the recording of all the colors is completed, it is possible to prevent dust or the like from being attached to the recording sheet 2 to prevent the thermal head from being damaged due to the dust or the like.

Figure 6:
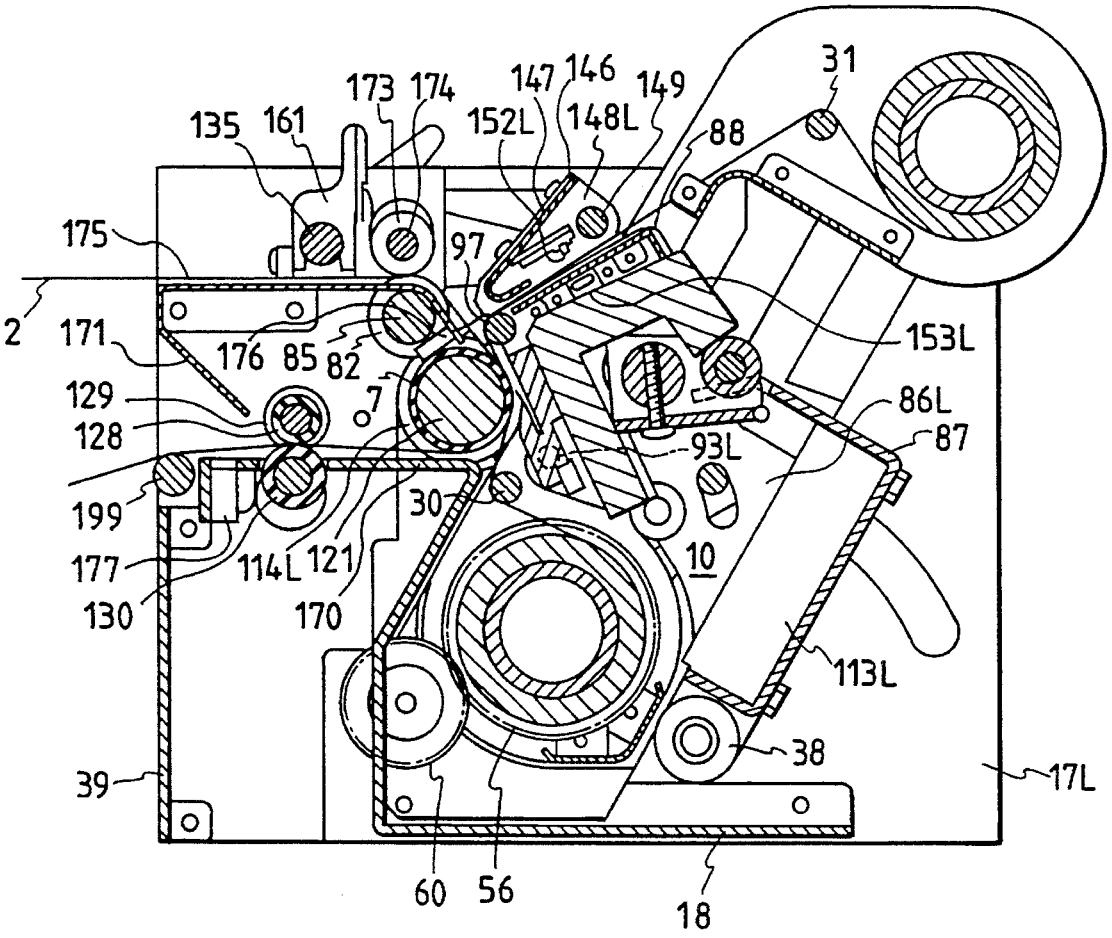
FIGS. 6 to 8 are cross-sectional views mainly showing an arrangement of a thermal head mechanism section of the printer according to the first embodiment.
Figure 7:
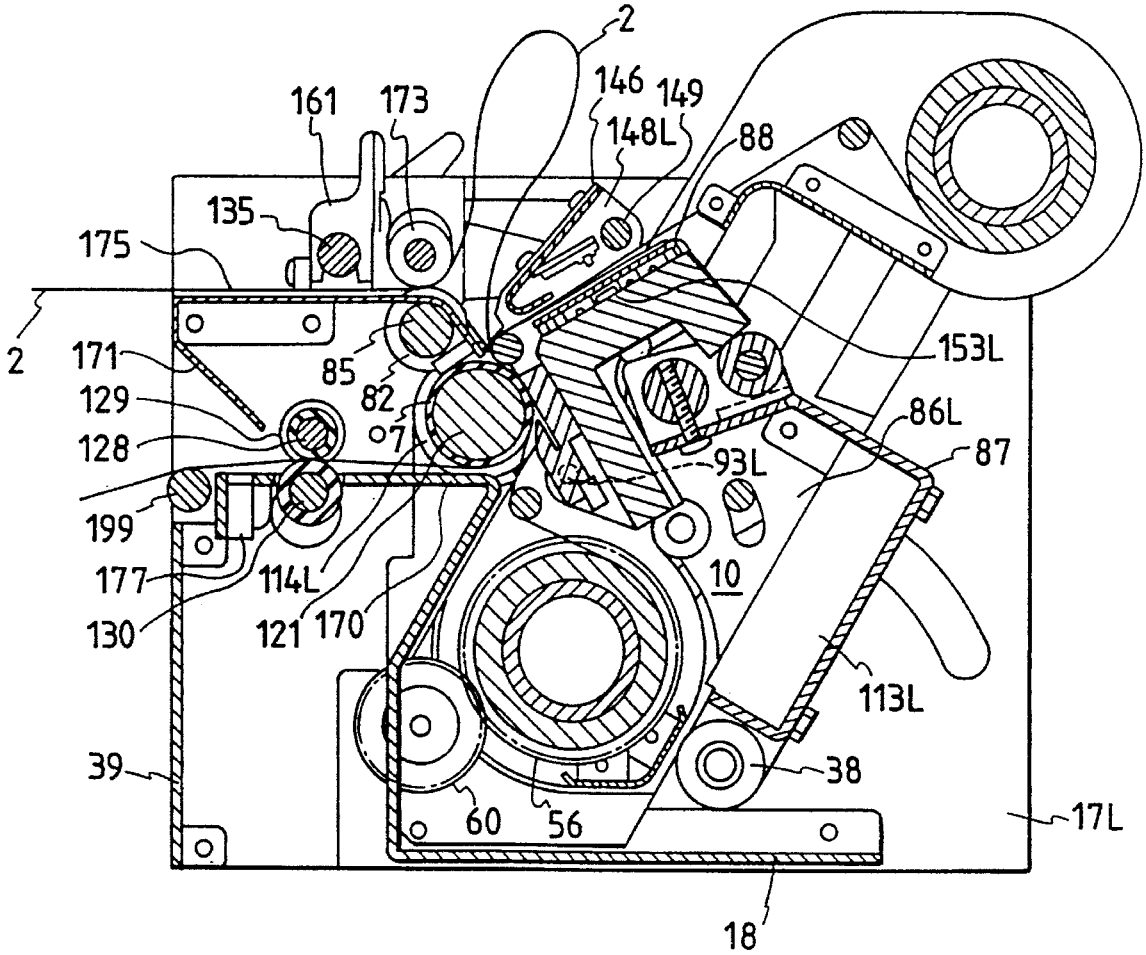
Figure 8:
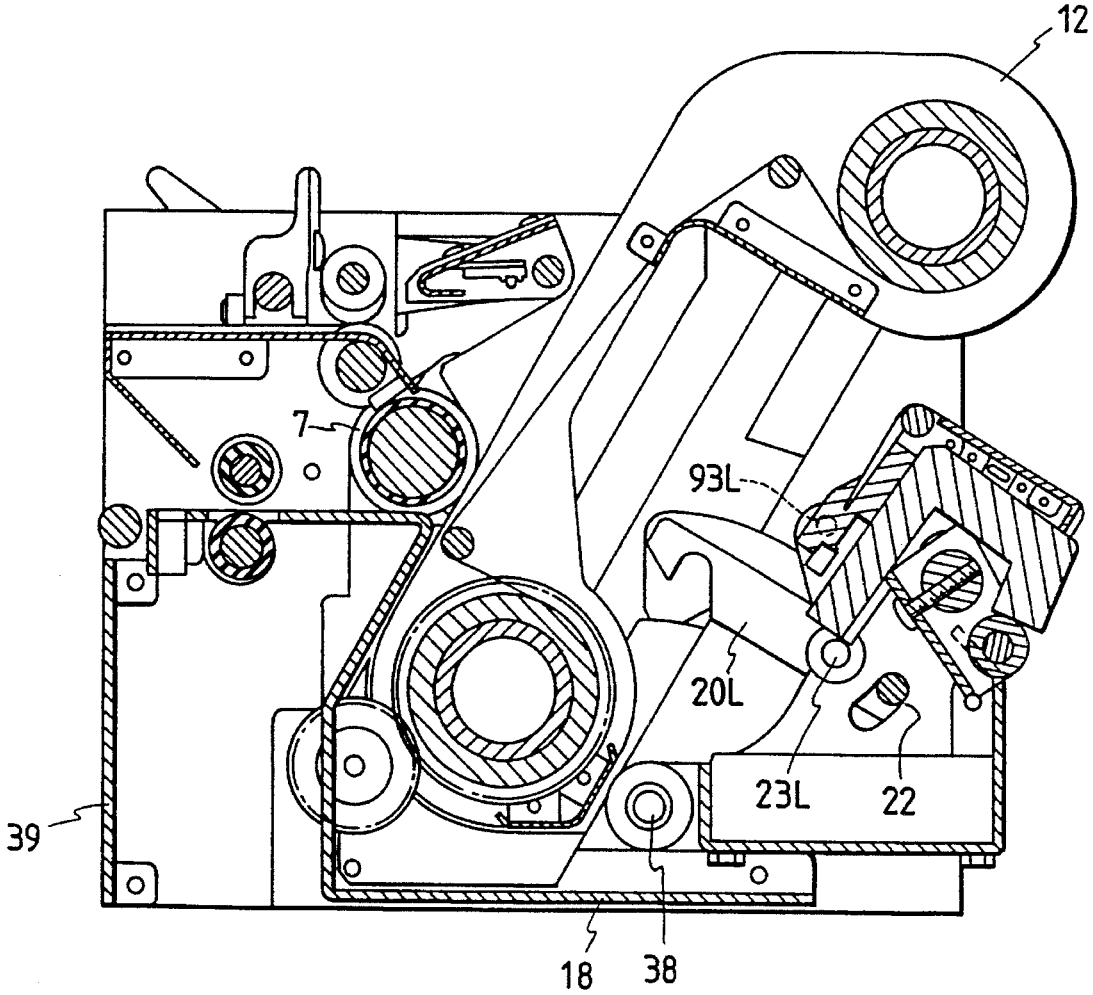
Figure 9:
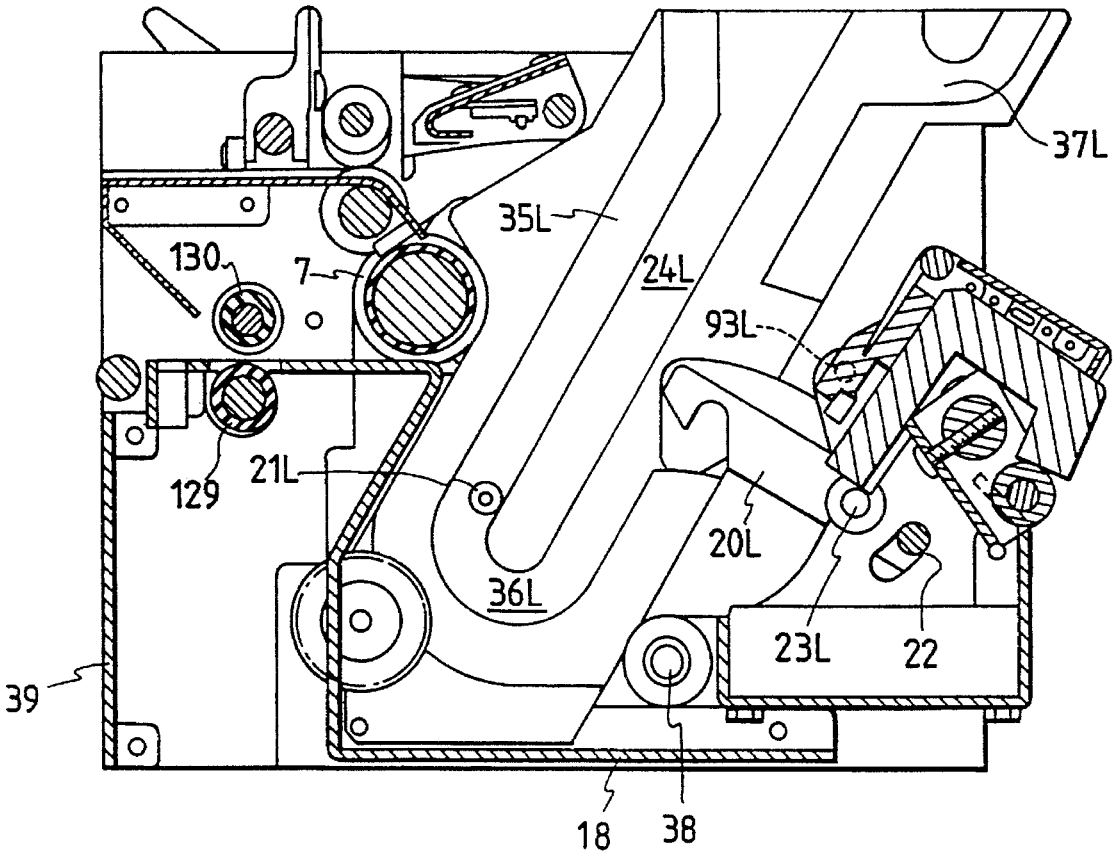
FIG. 9 is a cross-sectional view mainly showing a cartridge setting mechanism of the printer according to the first embodiment.

A description will be made hereinbelow in with reference to FIGS. 6 to 9 in terms of the printing mechanism section 4. FIG. 6 shows a state that the thermal head mechanism section 10 is set at a position taking the opposed relation to the platen roller 7, FIG. 7 shows a state that a thermal head (91) is further rotated counterclockwise from the FIG. 6 state to be brought into contact with the platen roller 7, FIG. 8 shows a state that the thermal head mechanism section 10 is greatly rotated clockwise about a shaft 38 up to the retreating position, and FIG. 9 shows a state that the cartridge 12 is removed from the FIG. 8 retreating state. The mechanism section 4 is supported by left and right aluminium-die-casting-made frames 17L and 17R, a Z-shaped stay 18 and an I-shaped stay 39. The frames 17L and 17R are coupled through the stays 18 and 39 to each other. As illustrated in FIGS. 6 to 9, the thermal head mechanism 10 is rotatable about the shaft 38, and when positioned at the platen roller 7 side, fixing claws 20R and 20L (see FIGS. 8 and 9) provided at the right and left sides of the thermal head mechanism section 10 are engaged with fixing pins 21R and 21L fitted in the right and left frames 17R and 17L so as to fix the thermal head mechanism section 10. The fixing claws 20R and 20L are integrally fixed to a shaft 22 so as to be rotatable about shafts 23R and 23L. Here, the fixing claws 20R and 20L are biased counterclockwise (in FIG. 9) by means of springs, not shown. For releasing the engagement between the fixing claws 20R, 20L and the fixing pins 21R, 21L, the fixing claws 20R and 20L are rotated clockwise against the biasing forces of the springs by means of a lock releasing mechanism which will be described hereinafter. The cartridge 12 is guided along rails 24R and 24L provided on the frames 17R and 17L so as to be movable up and down to be connected and disconnected to and from the apparatus when the thermal head mechanism section 10 takes the retreating state.

Figure 10:
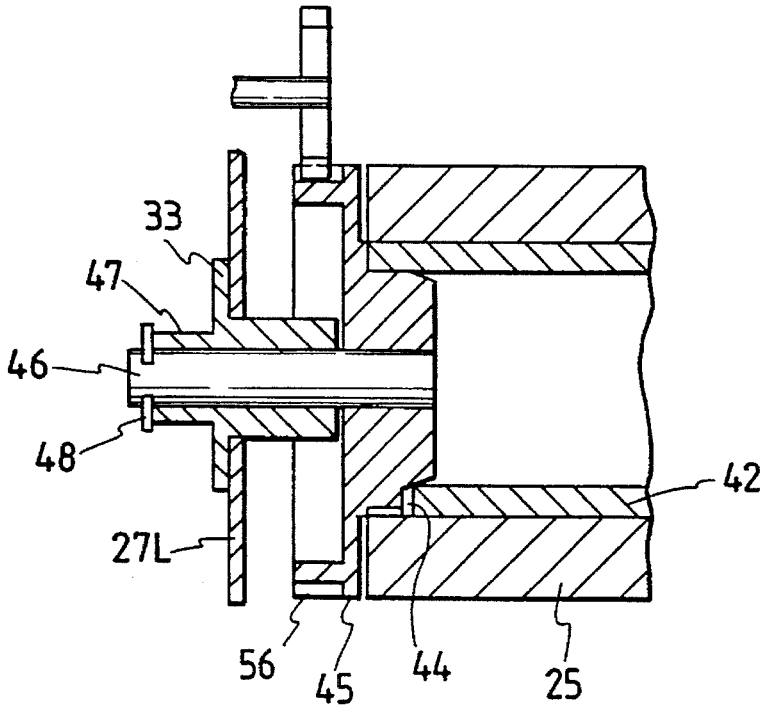
FIGS. 10 to 12 are cross-sectional views showing an arrangement of a transfer sheet holding section of the printer according to the first embodiment.
Figure 12:
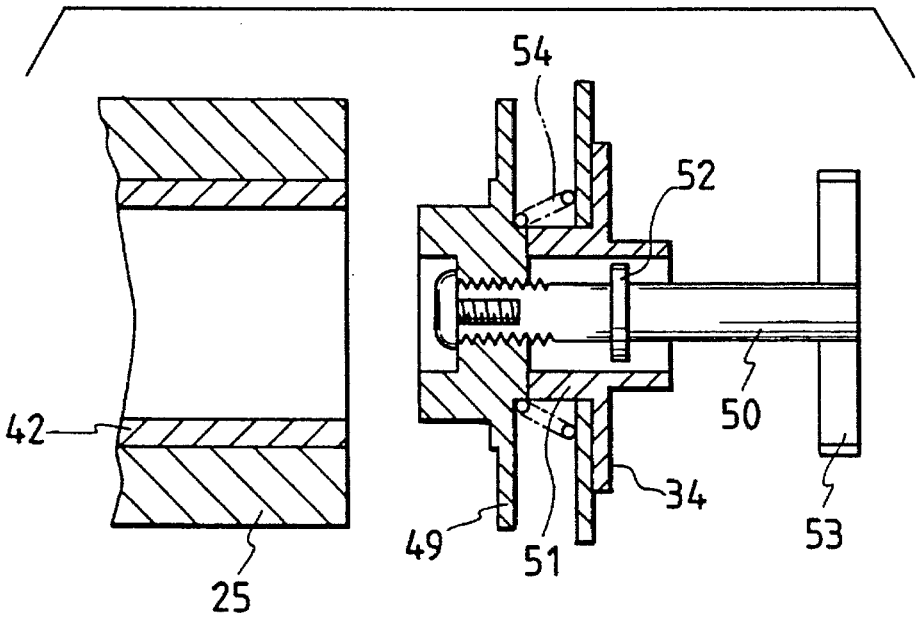
Figure 13:
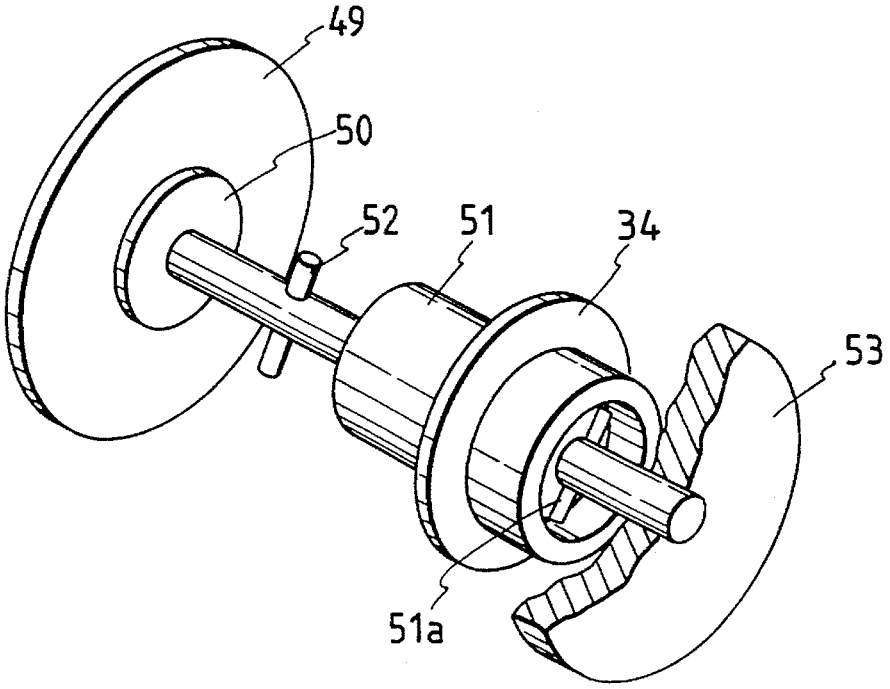
FIG. 13 is a perspective view showing the cartridge holding section of the printer according to the first embodiment.
Figure 14:
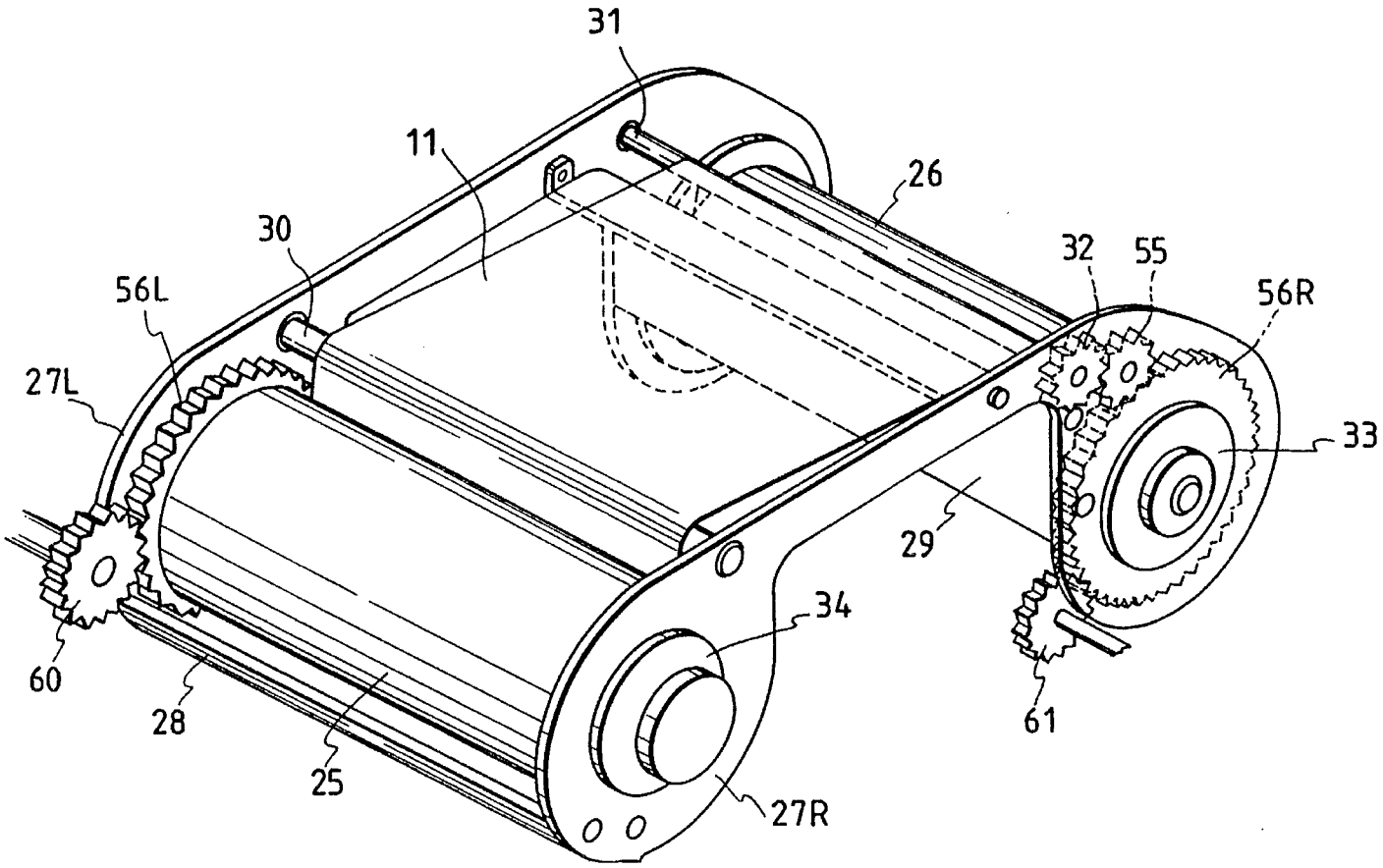
FIG. 14 is a perspective view showing a cartridge to be used in the printer according to the first embodiment.

Secondly, a description will be made hereinbelow with reference to FIGS. 10 to 14 in terms of an arrangement of the cartridge 12 for encasing and holding the transfer sheet 11. As illustrated in FIG. 14, the cartridge 12 comprises a frame constructed with right and left side surface portions 27R, 27L and two stays 28, 29 for connection between the side surface portions 27R, 27L. Also included are a supply roll 25 and take-up roll 26 which are formed by winding the transfer sheet 11 around cylindrical transfer cores 42 and 43, respectively. Notch channels 44 are formed at end portions of the cylindrical transfer sheet cores 42 and 43 as illustrated in FIG. 10. These notch channels 44 are connected to a take-up drive system which will be described hereinafter. Here, a right side supporting structure of the supply roll 25 is the same as a left side supporting structure of the take-up roll 26 and the left side supporting structure of the supply roll 25 is the same as a right side supporting structure of the take-up roll 26. Accordingly, the description will be made only in terms of the supply roll 25.

Figure 11:
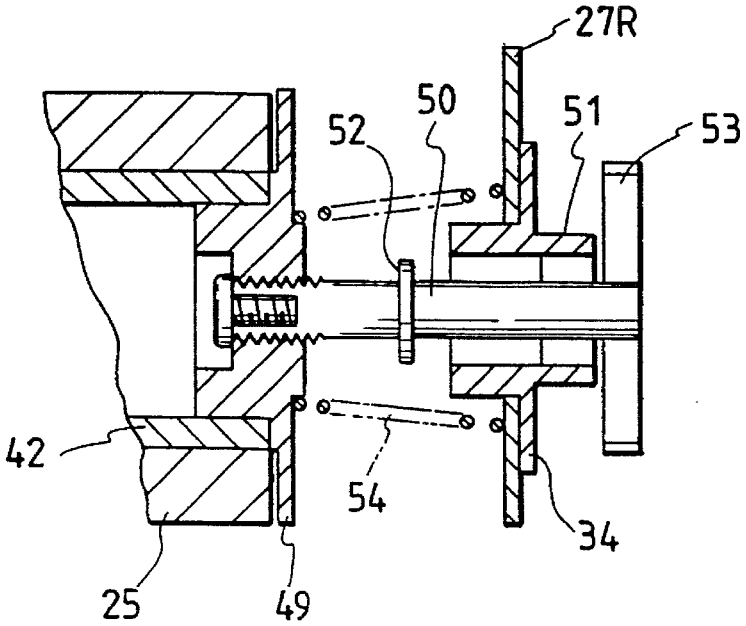

As illustrated in FIG. 10, in the left end portion of the supply roll 25, a left flange 45 is fit into the hollow of the cylindrical transfer sheet core 42, and a shaft 46 fixedly inserted into the left flange 45 is rotatably supported by a bearing 47 provided one the left side surface portion 27L of the cartridge 12. The left flange 45 integrally has a gear (toothed wheel) 56 to be engaged with a drive system which will be described hereinafter. Here, numeral 48 is an E ring for prevention of the falling-out. On the other hand, in the right end portion of the supply roll 25, as illustrated in FIG. 11, a right flange 49 is fitted in the hollow of the cylindrical transfer sheet core 42, and a shaft 50 attached through a screw to the right flange 49 is rotatably supported by a bearing 51 provided on the right side surface portion 27R of the cartridge 12. A knob 53 is fixedly placed on the other end portion of the shaft 50 which is at the opposite side to the flange 49. Between the right side surface portion 27R of the transfer sheet cartridge 12 and the flange 49 there is provided a tapered coil spring 54 which always biases the flange 49 in the left direction in FIG. 11. Further, as illustrated in FIG. 13, the bearing 51 has an I-shaped groove 51*a* which allows a pin 52 vertically penetrating the shaft 50 to pass therethrough. Thus, even if the knob 53 is held and pulled against the tapered coil spring 54 in the right direction in FIG. 11, when the direction of the I-shaped groove 51*a* is not coincident with the direction of the pin 52, the flange 49 can be prevented from being completely fallen out from the cylindrical core 42. As a result, it is possible to prevent the supply roll 25 from being fallen out due to misoperation. On the other hand, if the knob 53 is pulled in the right direction with the I-shaped groove 51*a* and the pin 52 being coincident in direction with each other, the supply roll 25 can be disconnected from the flange 49 as illustrated in FIG. 12. Moreover, after the pin 52 is separated from the 1-shaped groove 51*a*, when the knob 53 is slightly rotated in the right or left direction and then released from the rotation, the I-shaped groove 51*a* is not coincident in direction with the pin 52 whereby the right flange 49 can be separated from the supply roll 25 and kept as it is. Further, when in this state the knob 53 is rotated in the opposite direction so that the pin 52 and the 1-shaped groove 51*a* are coincident in direction with each other, the right flange 49 can be restored to the original position (FIG. 11) by means of the biasing force of the tapered coil spring 54.

As described above, since the right flange 49 can be separated from the supply roll 25 and kept as it is with a simple structure, it is possible to make easy the exchanging work of the supply roll 25 concurrently with preventing the supply roll 25 from being fallen out due to misoperation.

Between the supply roll 25 and the take-up roll 26 there are provided guide rollers 30 and 31 for guiding the transfer sheet 11. These guide rollers 30 and 31 are rotatably supported by the right and left side surface portions 27R and 27L. A gear 32 is fixedly secured to the right side end portion of the guide roller 31 and engaged through an idler 55 with a gear 56R of the take-up roll 26 right flange so as to be rotatable in the opposite direction to the take-up roll 26 in conveying the transfer sheet 11.

Figure 15:
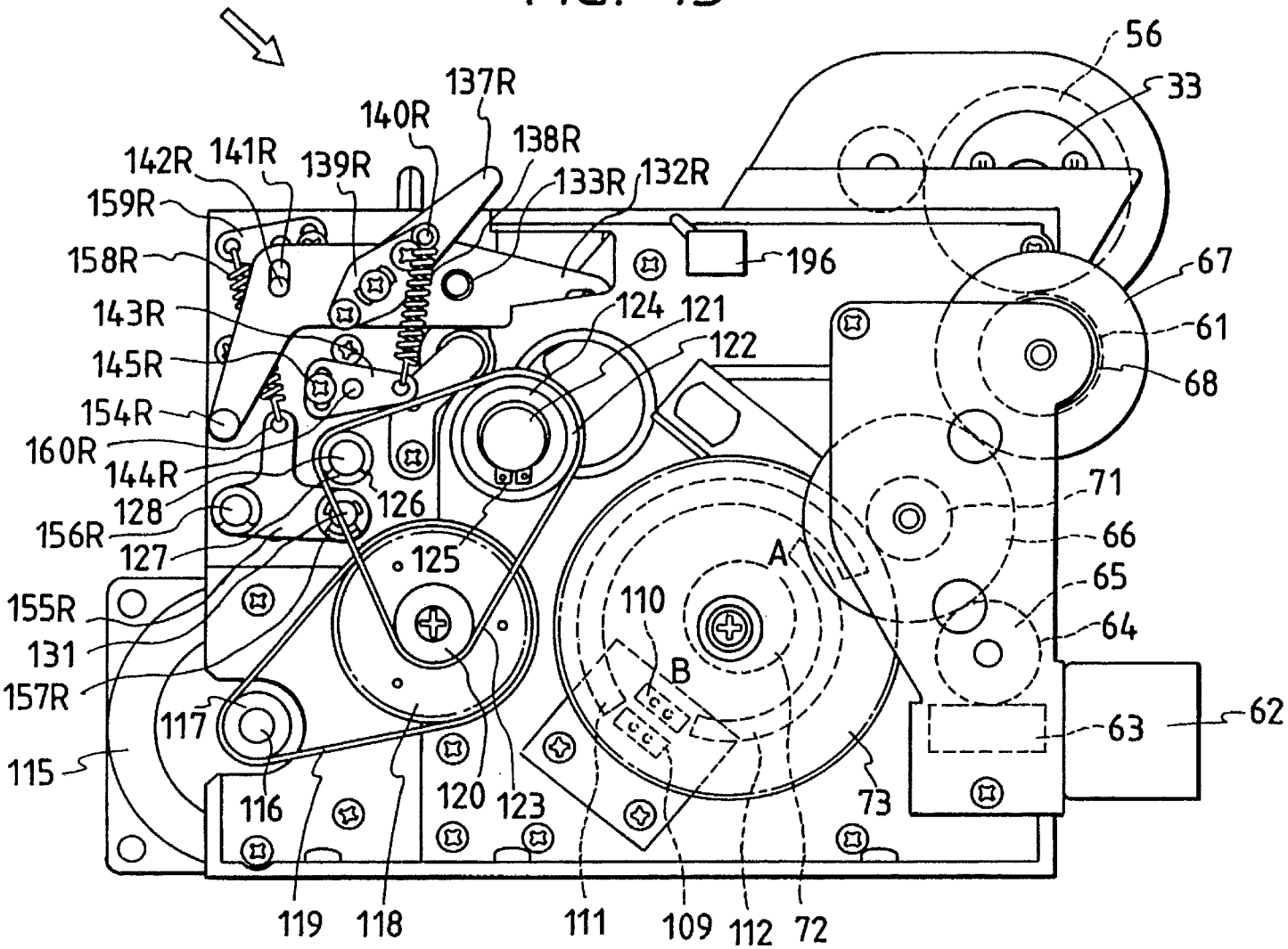
FIG. 15 is a right side view showing a mode of a mechanism section of the printer according to the first embodiment.
Figure 16:
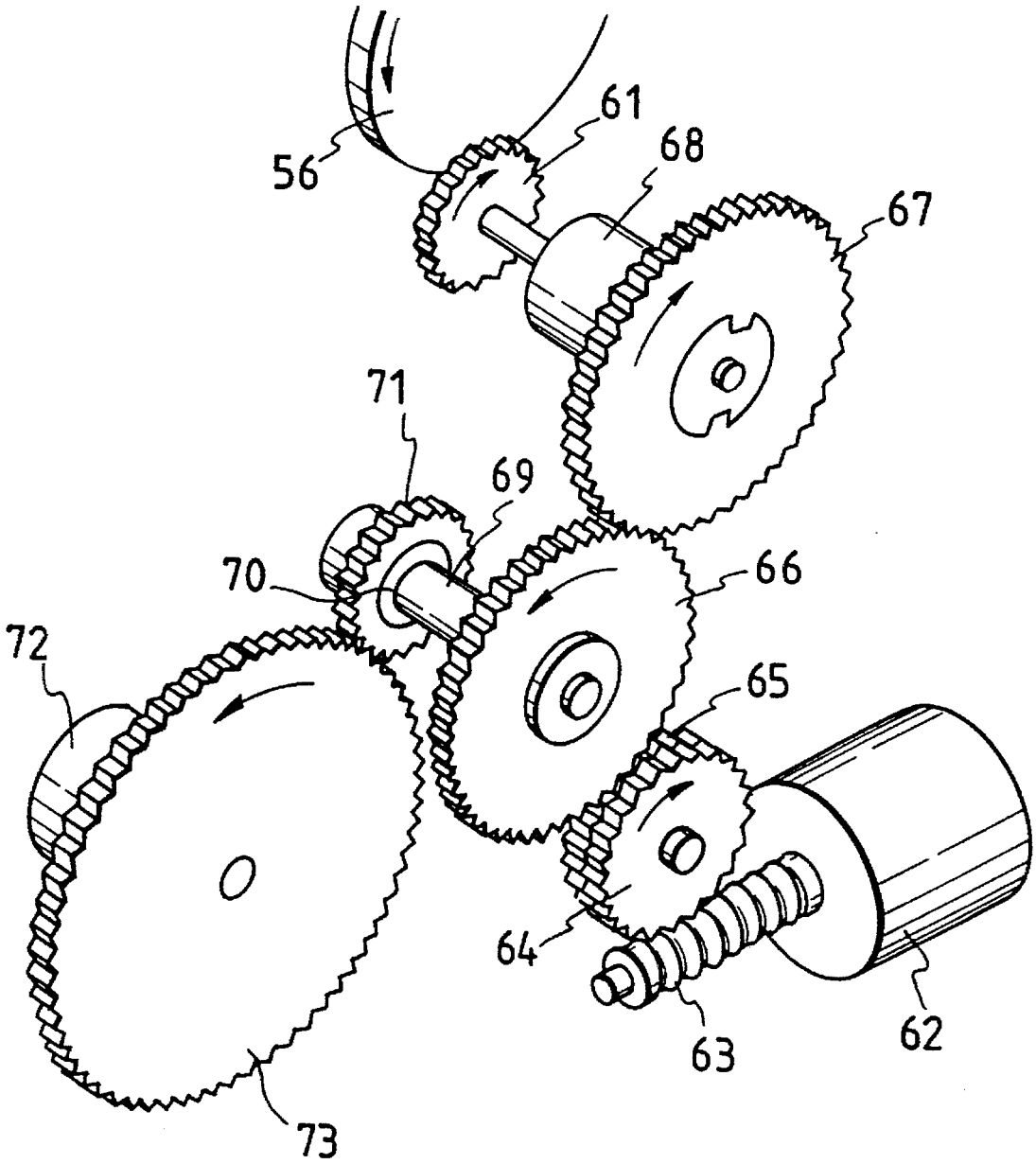
FIG. 16 is a perspective view showing a transfer sheet take-up and pressure cam driving system of the printer according to the first embodiment.
Figure 17:
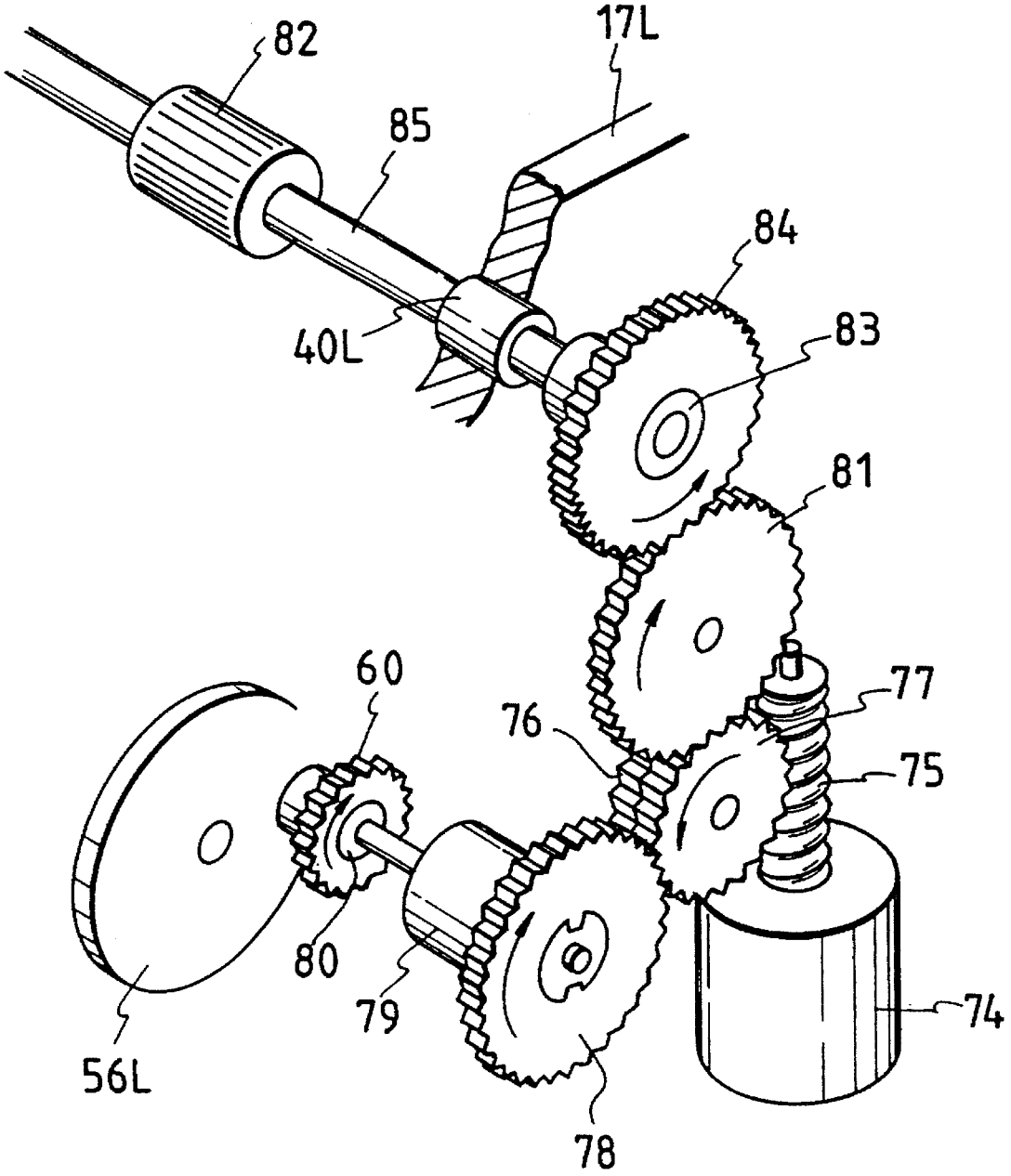
FIG. 17 is a perspective view showing a transfer sheet rewinding and clamping roller rotating drive system of the printer according to the first embodiment.
Figure 24:
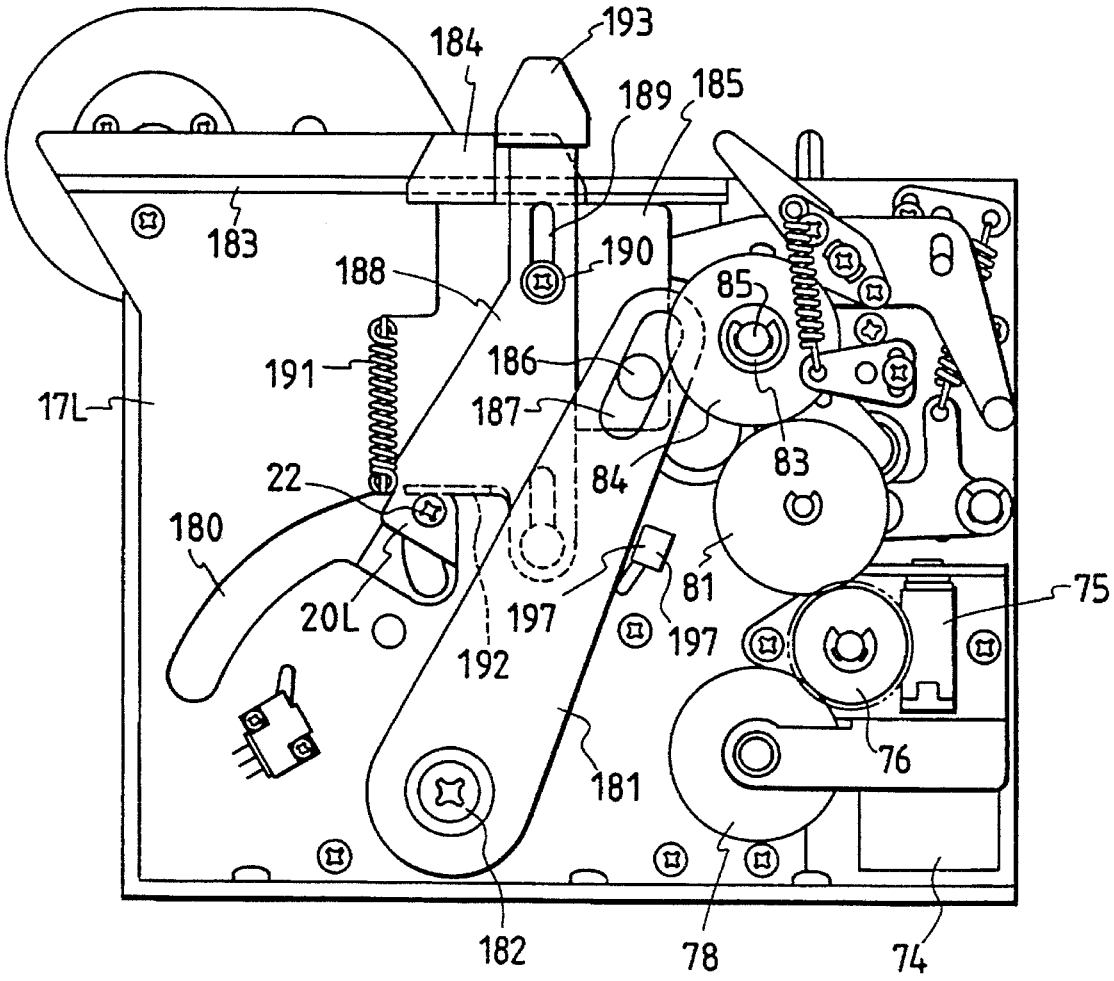
FIG. 24 is a left side view showing the mechanism section of the printer according to the first embodiment when the thermal head mechanism section is locked.

For mounting the cartridge 12 at a predetermined position of the printer 1, flange portions 33 and 34 of the bearings 47 and 51 to be protruded from the right and left side surface portions 27R and 27L of the cartridge 12 as illustrated in FIG. 14 are engaged with U-shaped groove portions 35R and 35L of the right and left rails 24R and 24L provided on the right and left frames 17R and 17L as illustrated in FIG. 9 and the cartridge 12 is then dropped along the U-shaped groove portions 35R and 35L. When the cartridge 12 is set at the predetermined position, the flange portions 33 and 34 of the supply roll 25 come into contact with lower curved portions 36R and 36L of the rails 24R and 24L, and the flange portions 33 and 34 of the take-up roll 26 come into contact with upper curved portions 37R and 37L, thereby positioning the cartridge 12. Further, when the cartridge 12 is mounted at the predetermined position and positioned thereat, the supply roll 25 side gear 56L is engaged with a slack-removing gear 60 and the take-up roll 26 side gear 56R is engaged with a take-up gear 61. As shown in FIGS. 15 and 16, the take-up gear 61 is driven to be reduced by a worm 63 directly coupled to a motor 62 and a worm wheel 64 coupled to the worm 63 and further reduced by a gear 65 constructed together with the worm wheel 64 and gears 66 and 67. The gear 67 is coaxially disposed with respect to the take-up gear 61 with a torque limiter 68 being interposed therebetween and arranged to slip when the winding load of the transfer sheet 11 exceeds a predetermined value. The gear 66 and the shaft 69 are integrally constructed and a one-way clutch 70 is provided on the shaft 69 and a gear 71 is provided on the one-way clutch 70. This gear 71 is engaged with a gear 73 integrally constructed with a pressure cam 72 which will be described hereinafter. In FIG. 16, when the shaft 69 rotates counterclockwise, the one-way clutch 70 slips so that the gear 71 does not rotate, and in response to only the clockwise rotation thereof, the one-way clutch 70 transmits the rotation. Further, as shown in FIGS. 17 and 24, the looseness-removing gear 60 is driven to be reduced through a worm 75 directly coupled to a motor 74 and a worm wheel 76 coupled to the worm 75 and further reduced through a gear 77 integrally constructed together with the worm wheel 76 and a gear 78. The gear 78 and the looseness-removing gear 60 are coaxially constructed and a torque limiter 79 and a one-way clutch 80 are disposed therebetween. In FIG. 17, the one-way clutch 80 takes the connection state to cause the slack-removing gear 60 to rotate when the gear 78 rotates clockwise, while, when a load above a predetermined value is applied to the slack-removing gear 60, the torque limiter 79 slips. Here, when the gear rotates counterclockwise, the slack-removing gear 60 does not rotate due to the one-way clutch 80. Further, the gear 77 is coupled through an idle gear 81 to a gear 84 connected through a one-way clutch 83 to a shaft 85 of a clamping roller 82 which will be described hereinafter. Here, the one-way clutch 83 is arranged to transmit rotation only when the gear 84 rotates clockwise in FIG. 17.

Figure 18:
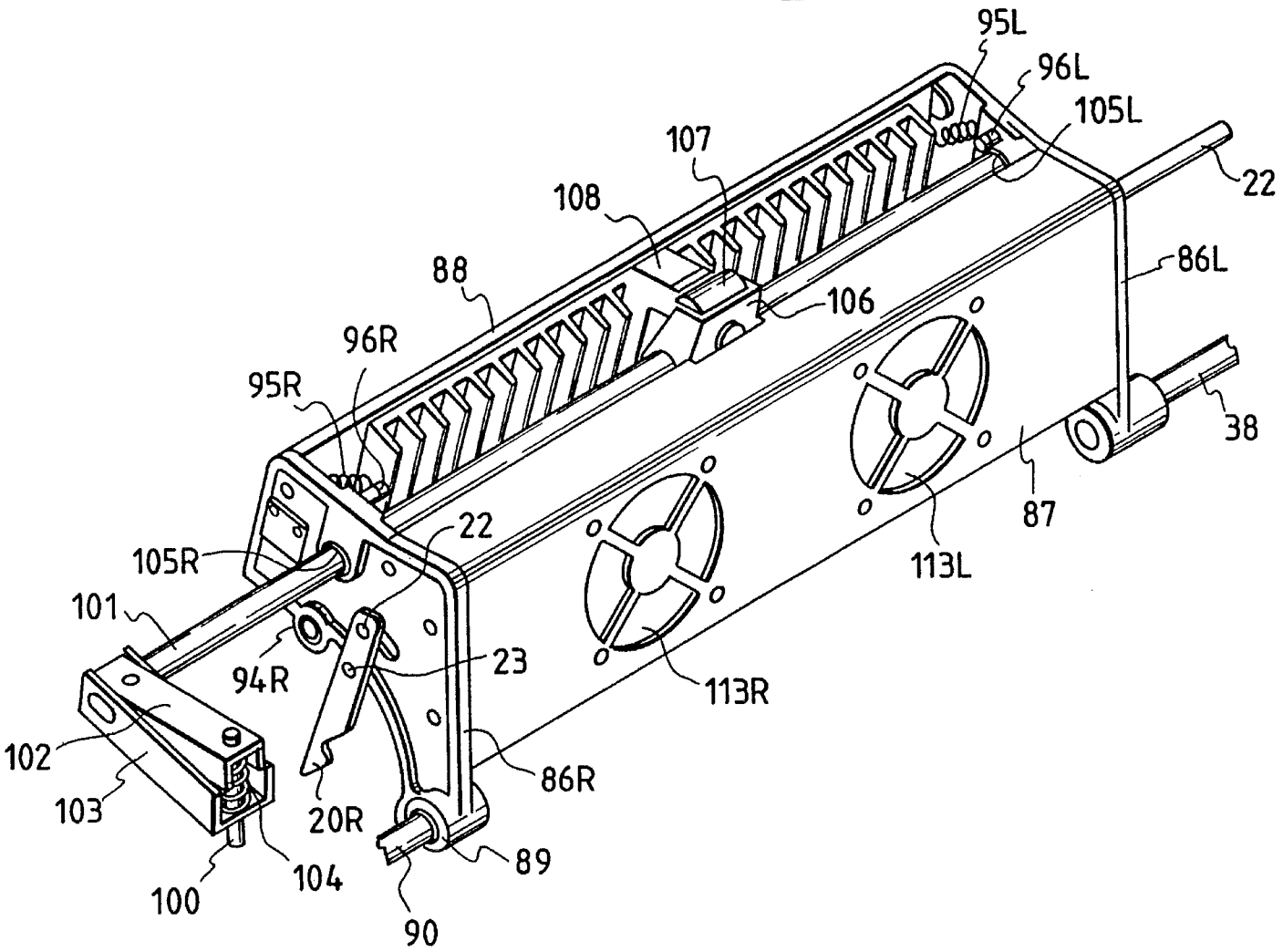
FIG. 18 is a perspective view showing a thermal head mechanism section of the printer according to the first embodiment.
Figure 19:
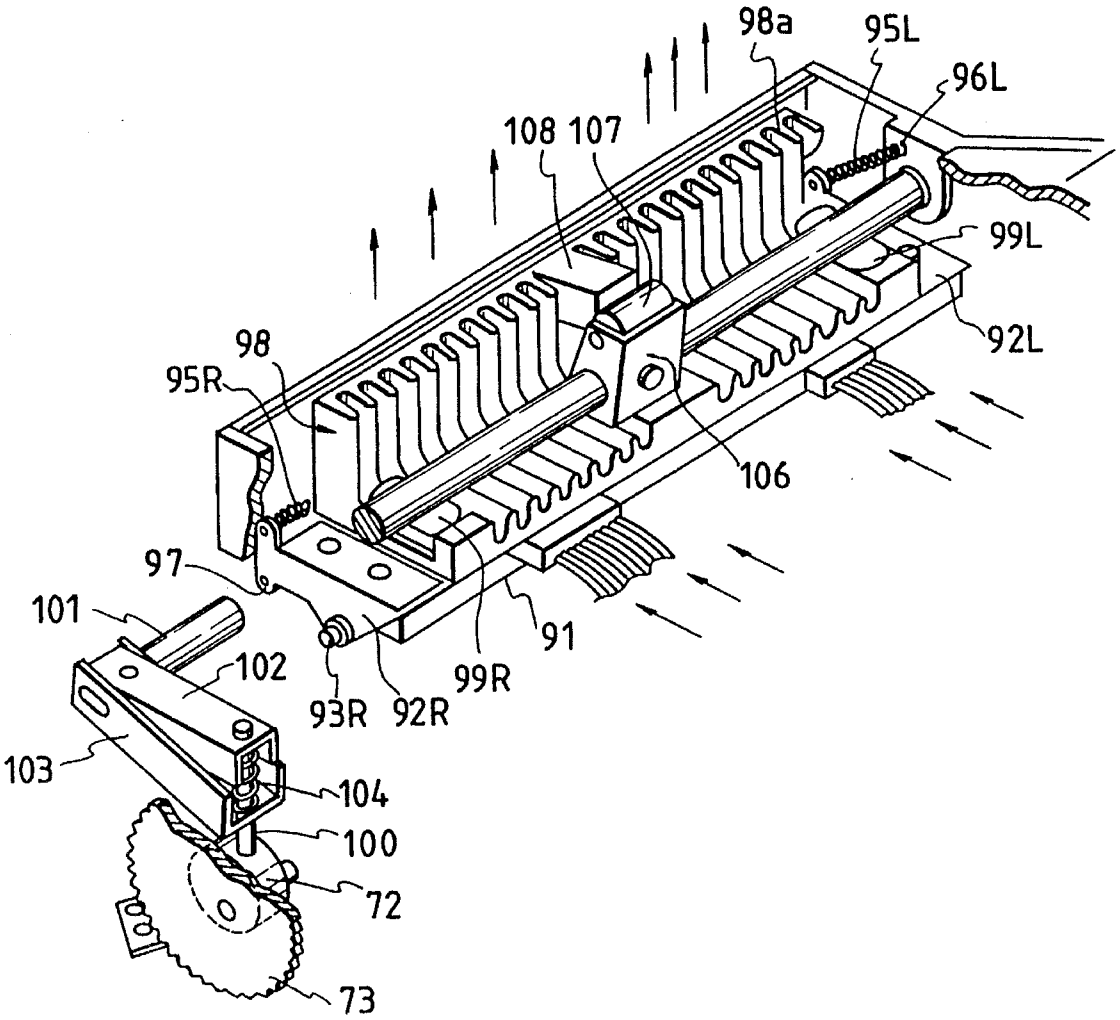
FIG. 19 is an exploded and perspective view showing the thermal head mechanism section of the printer according to the first embodiment.

Further, a description will be made hereinbelow with reference to FIGS. 6, 18 and 19 in terms of the thermal head mechanism section 10. The frame of the thermal head mechanism section 10 basically comprises right and left aluminium die-casting side plates 86R, 86L and two stays 87, 88 for connection between the side plates 86R and 86L. The right side plate 86R is supported by a shaft 90 and the left side plate 86L is supported by the shaft 38 so that the thermal head mechanism section 10 is rotatable. That is, the right side plate 86R is rotatably supported by the shaft 90, one end of which is planted in the right frame 17R of the printer 1, with the other end of the shaft 10 being fitted into a metal bearing 89, and the left side plate 86L is rotatably supported by the shaft, one end of which is planted in the left frame 17L, with the other end being inserted into a metal bearing, not shown. As shown in FIG. 19, a thermal head 91 is rotatably supported by shafts 93R, 93L provided on members 92R and 92L fixed by screws at both sides of the thermal head mechanism section 10 and inserted into metal bearings 94R and 94L provided on the right and left side plates 86R and 86L. Further, springs 95R and 95L are provided between front portions of the members 92R, 92L and spring-fitting portions 96R, 96L provided on the side plates 86R, 86L, whereby the thermal head 91 is urged upwardly, i.e., in a direction separated from the platen roller 7. Moreover, a transfer sheet guide roller 97 is supported by the members 92R and 92L and disposed at a downstream side of the thermal head 91 in the travelling passage of the transfer sheet 11 to guide the used transfer sheet 11. The transfer sheet guide roller 97 is arranged to be moved or inserted into the inside of the common tangent line of both the clamping roller 82 and platen roller 7, i.e., the platen roller 7 side, when the thermal head 91 is brought into contact with the platen roller 7. With this arrangement, it is possible to completely remove the looseness of the recording sheet 2 which occurs in reverse feeding of recording sheet or in other cases.

Further, a heat sink 98 having a substantially L-shaped configuration is attached through a paste having an excellent thermal conductivity to the back surface of the thermal head 91. For increasing the surface area of the heat sink 98, a plurality of radiating plates 98*a* each having an L-shaped configuration are provided on the heat sink 98 as illustrated in FIG. 19. When air blasting is affected from the back side of the thermal head 91, the air flows along the L-shaped configuration to be discharged toward the upper side thereof. At both right and left side portions of the heat sink 98 there are provided heaters 99R and 99L. The temperature of the thermal head 91 is detected by a means such as a thermistor, not shown, provided therein so that the air blasting cooling or heating is affected to keep the temperature of the thermal head 91 to a predetermined value. A pair of right and left fans 113R and 113L for the air blasting are fixedly secured to the abovementioned stay 87 so that air generated is limited in direction by the stay 87 and the transfer sheet supply roll 25 so as to be led to the L-shaped heat sink 98.

The thermal head is driven by the eccentric cam (pressure cam) 72 integrally attached to the gear 73 which is responsive to the rotation of the motor 62 reduced as described above. A pin 100 following the pressure cam 72 is supported by arms 102 and 103, which are fixed to one end portion of a pressing (contact) shaft 101, so as to be vertically and linearly movable. Between the arms 102 and 103 there is provided a compression spring 104, one end portion of which is attached to the pin 100 and the other end portion of which presses the arm 102. Accordingly, the pin 100 is urged toward the pressure cam 72 side and the range of the vertical movement of the pin 100 is limited by the arm 103. The other end portion of the pressing shaft 101 passes through the insides of bearings 105R and 105L provided in the side plates 86R and 86L so that the pressing shaft 101 is rotatably supported by the bearings 105R and 105L. A pressing arm 106 is fixed to the pressing shaft 101 to be provided between the side plates 86R and 86L and a pressing roller 107 is rotatably provided on a tip portion of the pressing arm 106. Further, designated at numeral 108 is a roller receiver 108 integrally attached to a substantial center portion of the heat sink 98 to be positioned in opposed relation to the pressing roller 107. Here, since the thermal head 91 and the heat sink 98 are always biased upwardly by the springs 95R and 95L, the roller receiver 108 comes into contact with the pressing roller 107.

The pressing operation of the thermal head against the platen roller 7 is as follows. As described above, in response to the rotation of the motor 62, the pressure cam 72 is driven through the worm 63, worm wheel 64, gears 65, 66, one-way clutch 70 and gears 71, 73. The one-way clutch 70 transmits the rotation when the gear 66 rotates clockwise in FIG. 16. The rotational position of the pressure cam 72 is detected by two reflection type optical sensors 109 and 110. As illustrated in FIG. 15, two arc-like patterns 111 and 112 are printed on the back surface of the gear 73 and detected by the reflection type optical sensors 109 and 110 so as to detect the rotational position of the pressure cam 72. For example, these patterns 111 and 112 have white colors when the color of the gear 73 is black. Accordingly, a position A at which the two patterns 111 and 112 are simultaneously detected corresponds to a state in which the thermal head 91 is separated from the platen roller 7, and a position B in which the patterns 111 and 112 are not detected corresponds to a state that the thermal head 91 comes into contact with the paten roller 7 to press it, and a position in which one of the patterns 111 and 112 are detected corresponds to a state in which thermal head 91 takes an intermediate position.

In FIG. 16, when the gear 73 rotates counterclockwise, the pin 100 is pressed upwardly in accordance with the rotation of the pressure cam 72 so that the arm 102, together with the pressing shaft 101, rotates counterclockwise in FIG. 19. As a result, the pressing arm 106 also rotates counterclockwise and the pressing roller 107 presses the roller receiver 108. Because of being rotatably supported by the bearings 94R and 94L, the thermal head 91 rotates against the springs 95R and 95L. Even if the thermal head 91 comes into contact with the platen roller 7, the pressure cam 72 further rotates. At this time, the pin 100 is lifted against the spring 104 and the force of the spring 104 acts as a pressing force from the thermal head 91 to the platen roller 7. Further, the summit portion of the pressure cam 72 presses the pin 100, thus terminating the pressing operation. At this time, the direction of the reaction generated when the pin 100 presses the pressure cam 72 is coincident with the direction of the axis of the pressure cam 72 and hence the pressure cam 72 does not rotate in the reverse direction due to the reaction of the pin 100.

The separation of the thermal head 91 from the platen roller 7 is affected by the pressing cam 72 further rotating counterclockwise from the pressing position B to reach the separation position A. Due to the rotation of the pressing cam 72, the pin 100 returns due to the operation of the compression spring 104 and hence the arm 102 rotates clockwise so that the thermal head 91 is separated from the platen roller 7 by means of the springs 95R and 95L.

Figure 25:
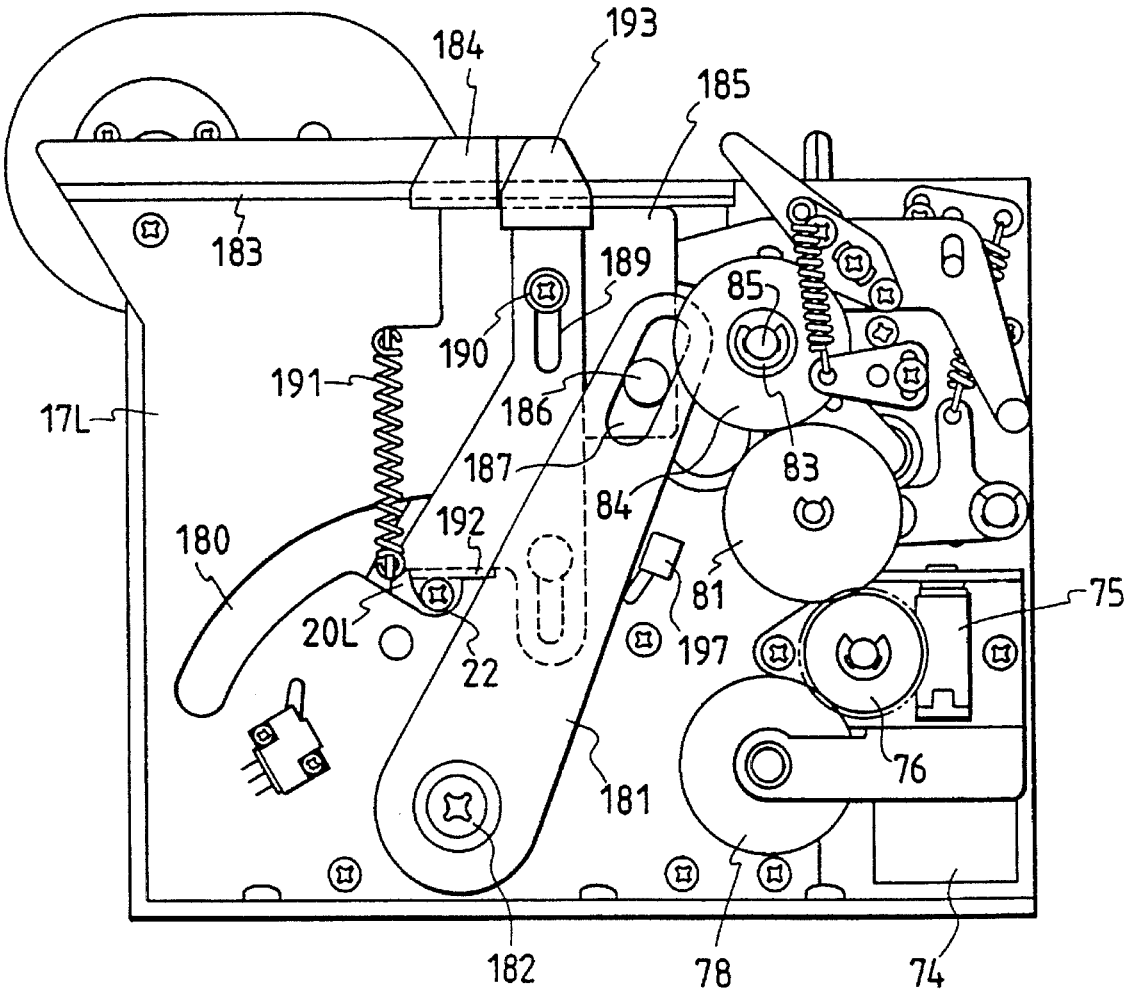
FIG. 25 is a left side view showing the mechanism section of the printer according to the first embodiment when the thermal head mechanism section is released from the locked state.
Figure 26:
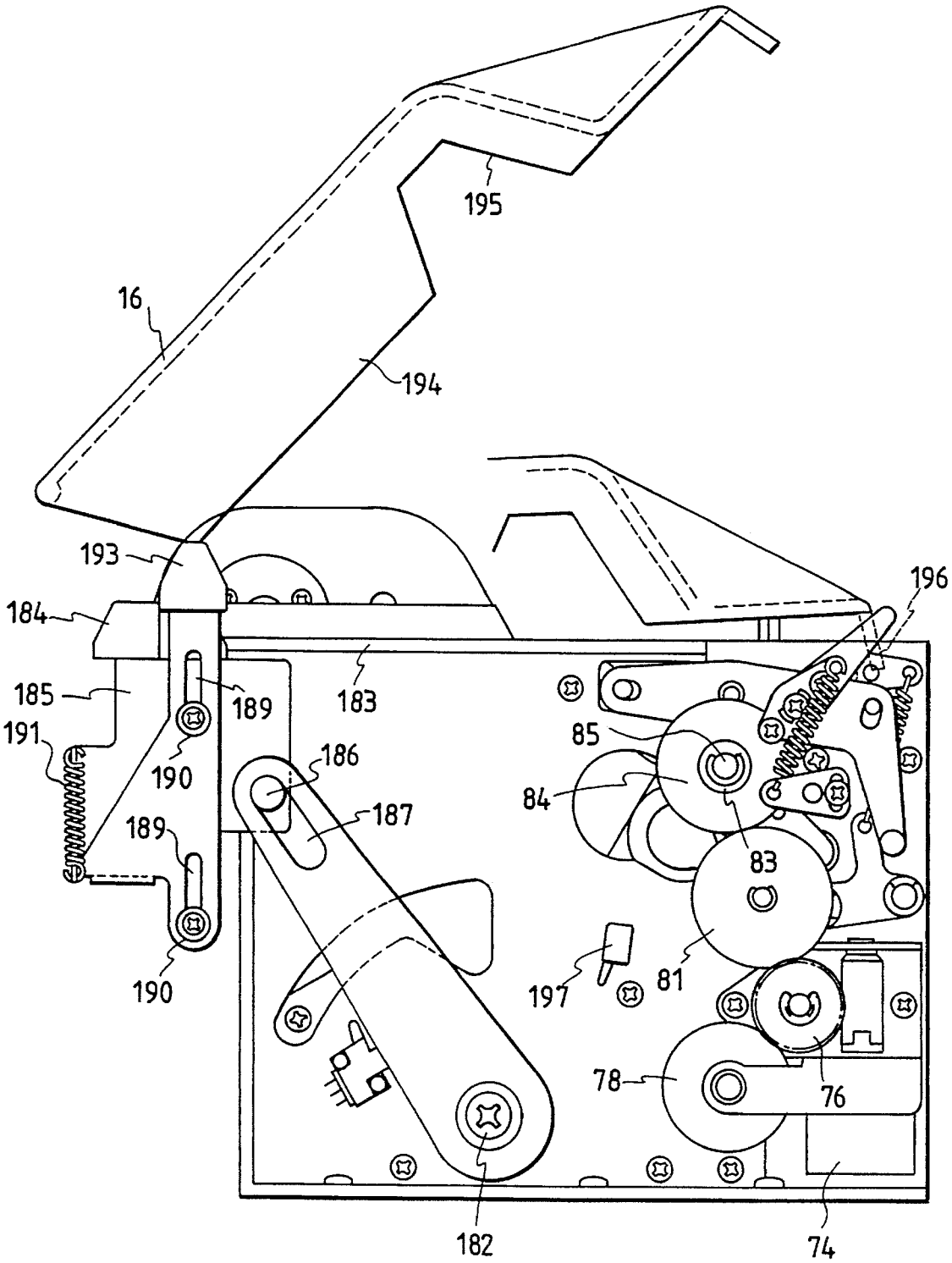
FIG. 26 is a left side view showing the mechanism section of the printer according to the first embodiment when the thermal head mechanism section takes the retreating state.

Moreover, a description will be made hereinbelow with reference to FIGS. 24 to 26 in terms of the retreating operation and setting operation of the thermal head mechanism section 10. As illustrated in FIG. 24, the shaft 22 which holds the fixing claws 20R and 20L as described above passes through an elongated hole 180 of the left frame 17L to extend up to the outside of the left frame 17L. Further, the shaft 38 which rotatably supports the thermal head mechanism section 10 also passes through a bearing, not shown, of the left frame 17L to extend up to the outside of the left frame 17L. A driven arm 181 is fixedly secured through a screw 182 to the tip portion of the shaft 38 protruded from the left frame 17L so as to be rotatable together with the thermal head mechanism section 10. Further, denoted at numeral 184, is a releasing control having a groove and provided at the upper portion of the left frame 17L. The releasing control 184 is arranged to be slidable in the right and left directions (in FIG. 24) along a rib 183 provided on the upper side of the left frame 17L. A plate base 185 is fixedly secured to the releasing control 184 and a pin 186 is caulked on the plate base 185. The pin 186 is inserted into and engaged with the elongated hole 187 formed in the tip portion of the above-mentioned driven arm 181 so that the sliding operation of the releasing control 184 is converted into a rotating operation of the driven arm 181. Moreover, on the plate base 185, there is provided a lock releasing plate 188 which is slidable up and down by means of a pair of elongated holes 189, 189 and a pair of guide pins 190, 190. Between the lock releasing plate 188 and the plate base 185 there is provided a spring 191 whereby the lock releasing plate 188 is urged upwardly (in FIG. 24) with respect to the plate base 185. Further, a curved portion formed at a lower portion of the lock releasing plate 188 comes into contact with the tip portion of the shaft 20L, and hence, when the lock releasing plate 188 is pressed downwardly against the spring 191 as illustrated in FIG. 25, the fixing claws 20R and 20L rotate to be separated from the fixing pins 21R and 21L. Here, numeral 193 represents a lock releasing knob integrally coupled to the lock releasing plate 188. As shown in FIG. 25, when sufficiently pressing the lock releasing knob 193, the lock releasing knob 193 becomes similar in height to the releasing control 184. When in this state the releasing control 184 moved in the left direction, the thermal head mechanism section 10 rotates to take the retreating state. At this time, if the lock releasing knob 193 is released, the lock releasing knob 193 returns by the spring 191, thereby taking a state as shown in FIG. 26 whereby the thermal head mechanism section 10 is fixed to the retreating state. For changing the thermal head mechanism section 10 from the retreating state to the set state, the releasing control 184 is moved in the right direction in FIG. 26, whereby the fixing claws 20R and 20L are automatically engaged with the fixing pins 21R and 21L to be locked.

Here, when the releasing control 184 is positioned at the left side, that is, when the thermal head mechanism section 10 is in the retreating state, a left side wall portion 194 of the above-mentioned cover 16 comes into contact with the releasing control 184 so that the cover 16 cannot be closed. On the other hand, when the releasing control 184 is at the right side, that is, when the thermal head mechanism section 10 takes the set state, a notch portion 195 of the left side wall portion 194 of the cover 16 is at the position of the releasing control 184 and hence the cover 16 can take the closed state. Moreover, in the state that the cover 16 is normally closed, a switch 196 indicated in FIG. 15 is depressed by the right side wall portion of the cover 16 whereby it is possible to detect the closed state of the cover 16. Further, when the thermal head mechanism section 10 is in the set state, a switch 197 is depressed by the driven arm 181 whereby it is possible to detect the set state of the thermal head mechanism section 10.

Further, a description will be made hereinbelow in terms of the travelling operation of the transfer sheet 11. In the state that the cartridge 12 is removed from the printer 1, the transfer sheet 11 is guided by the guide rollers 30, 31 and the stay 29 between the supply roll 25 and the take-up roll 26. In the state that the cartridge 12 is mounted on the printer 1 and the thermal head mechanism section 10 is set, after being drawn from the cartridge, as shown in FIG. 6, the transfer sheet 11 is guided in order of the supply roll 25, guide roller 30, platen roller 7, transfer sheet guide roller 97, guide roller 31 and take-up roll 26. This passage of the transfer sheet 11 is taken in the recording mode and transfer sheet heading mode which will be described hereinafter.

For preventing generation of wrinkles of the transfer sheet 11 in recording, it is important that the recording sheet 2 and the transfer sheet 11 come closely into contact with each other on the platen roller 7 and run at the same speed. In this printer 1, since the platen roller 7 always takes a contact state in a portion of the travelling passage of the transfer sheet 11, it is possible to appropriately keep the closely contacting state. Thus, even if the degree of parallelization of the supply roll 25, take-up roll 26, guide roller 30, 31 and others becomes slightly deteriorated, due to the platen roller 7 it is possible to appropriately affect the recording without a generation of wrinkles.

Moreover, a description will be made hereinbelow with reference to FIGS. 6 and 15 in terms of a drive system for the platen roller 7. The platen roller 7 comprises a metallic shaft and an elastic member such as rubber provided on the circumference of the metallic shaft. The platen roller 7 is rotatably supported through bearings 114R and 114L provided in the right and left frames 17R and 17L, and driven by a stepping motor 115 provided on the right frame 17R as illustrated in FIG. 15. The rotation of the stepping motor 115 is reduced through a pulley 117 fixed to the output shaft 116 of the motor 115, a pulley 118 rotated about a shaft planted on the right frame 17R, and a timing belt 119 provided between the pullies 117 and 118. In addition, the platen roller 7 is reduction-driven through a pulley 120 fixed to the pulley 118, a pulley 122 provided on a platen roller shaft 121, and a timing belt 123 stretched between the pullies 120 and 122. Between the platen roller shaft 121 and the pulley 122 there is provided a one-way clutch 124 which is arranged to transmit the rotation to the platen roller 7 side only when the pulley 122 rotates counterclockwise in FIG. 15. Further, the timing belt 123 is also coupled to a pulley 126 and the pulley 126 is attached through a one-way clutch 127 to a reversing roller shaft 128 which will be described hereinafter. This one-way clutch 127 is arranged to transmit the rotation to the reversing roller shaft 128 only when the pulley 126 rotates clockwise in FIG. 15. To a position of the reversing roller shaft 128 which corresponds to a substantial center portion of the thermal head 91, there is fixed a reversing roller 129 which is made of a material such as a rubber having a high frictional coefficient. Further, a non-driven roller 130 is provided to be in opposed relation to the reversing roller 129 with respect to the recording sheet 2. This non-driven roller 130 can be arranged to be brought close to the reversing roller 129 and separated therefrom by means of a means which will be described hereinafter.

Still further, a description will be made hereinbelow in terms of the clamping roller 82. As described above, in the case of being driven by the motor 74, the clamping roller 82 is rotatable through the one-way clutch 83 only in the clockwise direction in FIG. 17. The clamping roller 82 is made of a hard material and has a notch configuration such as knurling. The clamping roller 82, together with the non-driven roller 173, holds the recording sheet 2 so that the knurling teeth eat into the back surface of the recording sheet 2. In practice, a plurality of clamping rollers 82 are provided in the width directions of the thermal head 91 and the clamping roller shaft 85 is rotatable only in the clockwise direction by means of one-way clutches 40R and 40L fixed to the right and left frames 17R and 17L. Thus, when reversely feeding the recording sheet 2, the clamping roller 82 can be prevented from rotating counterclockwise due to the tension of the recording sheet 2.

Figure 20:
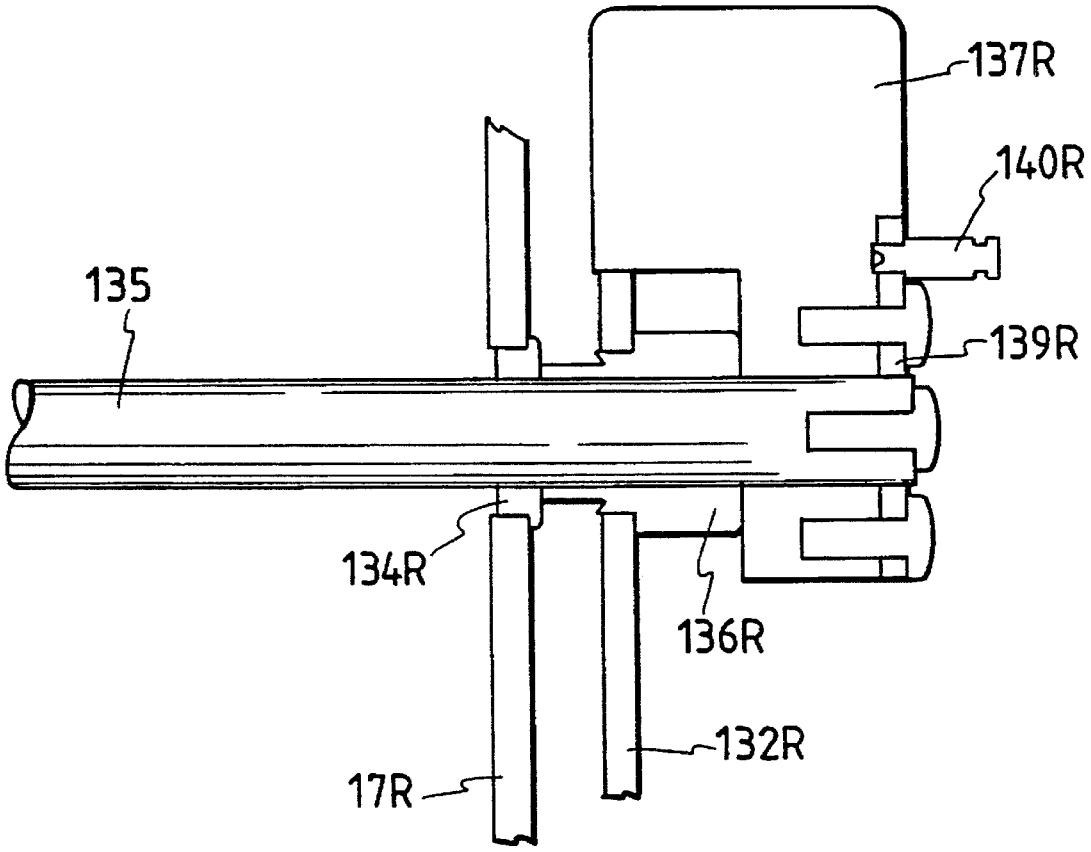
FIG. 20 is a cross-sectional view showing a set lever section of the printer according to the first embodiment.
Figure 21:
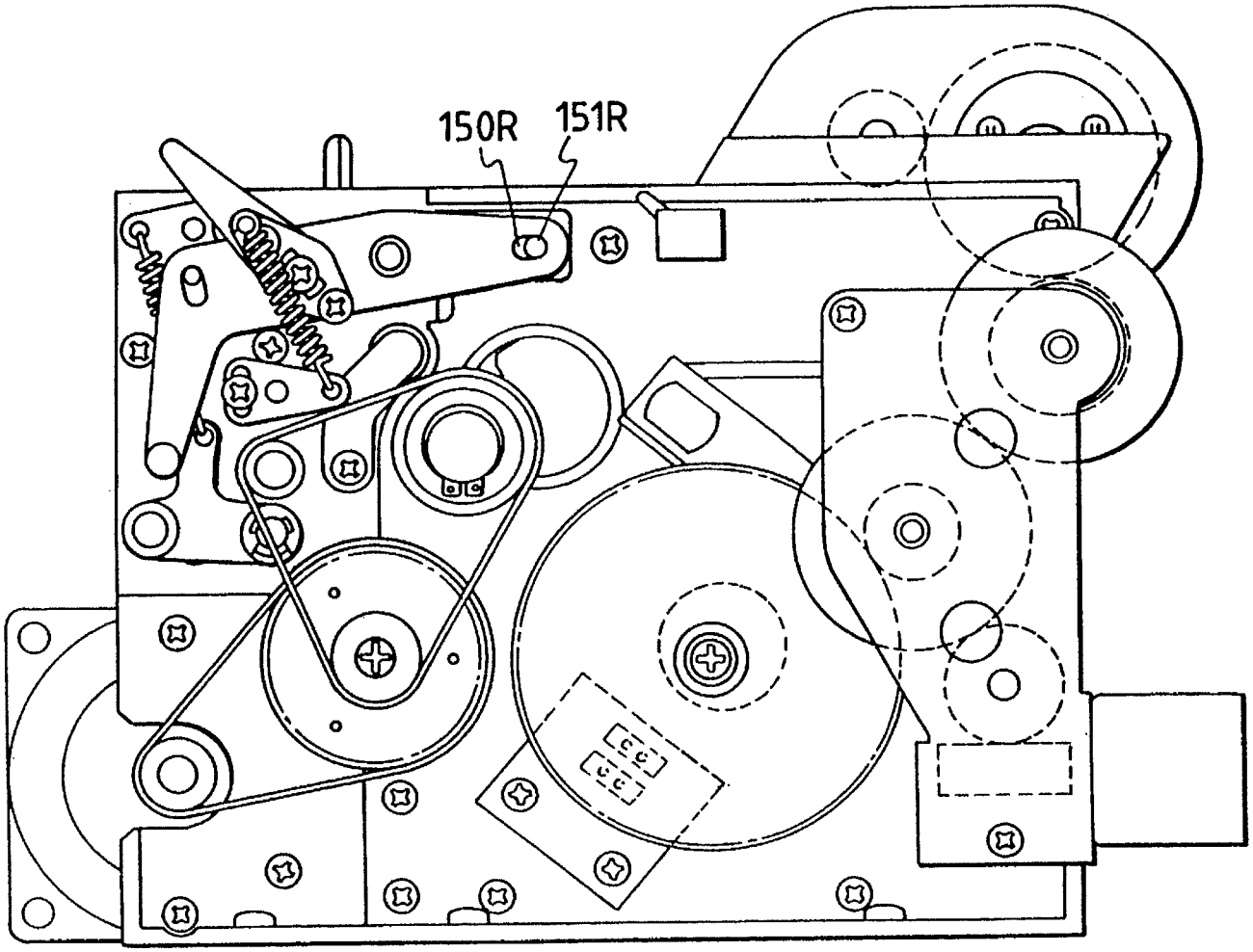
FIG. 21 is a right side view showing another mode of the mechanism section of the printer according to the first embodiment.

Designated at numeral 173 is a non-driven roller made of an elastic member such as rubber and fixed onto a shaft 174. The non-driven roller 173 is disposed at a position taking opposed relation to the clamping roller 82 with respect to the recording sheet 2. The shaft 174 penetrates the right and left frames 17R and 17L and are supported by one-way clutches 133R and 133L, fixed to moving levers 132R and 132L at the outside of the right and left frames 17R and 17L, so as to be rotatable only in the clockwise direction in FIG. 15. As illustrated in FIG. 20, the moving levers 132R and 132L are supported by bearings 136R and 136L so as to be rotatable about a shaft 135 supported by bearings 134R and 134L provided in the right and left frames 17R and 17L. Set levers 137R and 137L are respectively fixed to both ends of the shaft 135 and biased downwardly by springs 138R and 138L coupled to spring hooks 140R and 140L provided on the set levers 137R and 137L. References 139R and 139L are reinforcement members for the set levers 137R and 137L. In FIG. 15, when viewed from the direction indicated by an arrow, the set levers 137R and 137L substantially have L-shaped configurations, and portions of the set levers 137R and 137L come into contact with right side shoulder upper portions of the moving levers 132R and 132L so as to bias the moving levers 132R and 132L clockwise by the forces of the springs 138R and 138L. On the other hand, when being rotated counterclockwise (in FIG. 15) against the springs 138R and 138L, the set levers 137R and 137L exceeds the dead points to come into contact with the left shoulder upper portions of the moving levers 132R and 132L whereby the moving levers 132R and 132L rotate counterclockwise by the forces of the springs 138R and 138L, thus taking a state as illustrated in FIG. 21. As a result, the non-driven roller shaft 174 supported through the one-way clutches 133R and 133L on the moving levers 132R and 132L can be brought into contact with the clamping roller 82 and separated therefrom. That is, when the set levers 137R and 137L take positions rotated clockwise in FIG. 15, the clamping roller 82 and the non-driven roller 173 are brought into contact with and pressured to each other by means of the springs 138R and 138L to clamp the recording sheet 2. On the other hand, when the set levers 137R and 137L take positions rotated counterclockwise, the clamping roller 82 and the drive roller 173 are in the separated state. Further, this separation therebetween is limited by elongated holes 141R, 141L and pins 142R, 142L planted in the right and left frames 17R, 17L. Here, when the set levers 137R and 137L are at the counterclockwise rotated positions, the front portion of the side wall of the above-mentioned cover 16 comes into contact with the set levers 137R and 137L whereby the cover 16 cannot be closed. Thus, it is possible to easily detect this state with the switch 196 being not depressed.

As described above, the clamping forces for the recording sheet 2 are generated by the springs 138R and 138L, while the uniformity between the right and left side clamping forces affects the positional accuracy of the recording sheet 2. Since springs differ in force from each other, the spring forces are required to be adjusted so as to make the right and left side clamping forces uniform. For this adjustment, as illustrated in FIG. 15, one end of each of the springs 138R and 138L is respectively hooked by the spring hooking portions 140R and 140L of the set levers 137R and 137L and the other end thereof is respectively hooked by adjusting plates 143R and 143L fixed through screws 145R and 145L to the right and left frames 17R and 17L. The adjusting plates 143R and 143L are arranged to be rotatable about shafts 144R and 144L and fixed by screws 145R and 145L after rotated by appropriate amounts to adjust the spring forces.

The moving levers 132R and 132L have substantially L-shaped configurations, and one tip portions thereof enter into the insides of the right and left frames 17R and 17L to move a separation guide plate 146 and the other tip portions thereof cause the non-driven roller 130 to be brought into contact with the reversing roller 129 and separated therefrom. The separation guide plate 146 is for separation between the transfer sheet 11 and the recording sheet 2 after recorded, and comprises a metallic guide plate 147 and support blocks 148R, 148L provided at both outsides of the recording sheet 2 in the width directions. The separation guide plate 146 is rotatably supported by a shaft 149 penetrating the support blocks 148R and 148L. Further, the support blocks 148R and 148L have at outer sides pins 152R and 151L (see FIG. 21) which are in turn engaged with elongated holes 150R and 150L of the moving levers 132R and 132L so that the separation guide plate 146 is rotationally movable up and down about the shaft 149 in accordance with the rotational movements of the moving levers 132R and 132L (see FIGS. 6 and 8). Moreover, at the lower surface side of the guide plate 147 there are provided light sources 152R and 152L which detect the respective colors of the transfer sheet 11 to detect the position, and at positions of the thermal head mechanism section 10 side, which are in opposed relation to the light sources 152R and 152L with respect to the transfer sheet 11, there is provided light-receiving devices 153R and 153L. The light source 152R comprises a red-color LED (light emitting diode) and the light source 152L comprises a green-color LED. That is, this color detection is based on the fact that the red and green color lights pass through the yellow ink portion of the transfer sheet 11, and the red color light passes through the magenta ink portion of the transfer sheet 11 while the green color light does not pass through the magenta ink portion thereof, and further the red and green color lights do not pass through the cyan ink portion of the transfer sheet 11.

The contacting and separating operations of the non-driven roller 130 with and from the reversing roller 129 are affected with holding plates 155R and 155L of the non-driven roller 130 being pressed by pins 154R and 154L provided at the tip portions of the moving levers 132R and 132L. As shown in FIG. 15, the holding plates 155R and 155L respectively have substantially T-shaped configurations. First end portions of the holding plates 155R and 155L are rotatably supported by shafts 156R and 156L planted in the right and left frames 17R and 17L, second end portions thereof rotatably support the drive roller shaft 131 through bearing 157R and 157L, and third end portions thereof act as spring hooking portions 160R and 160L. Springs 158R and 158L are stretched between the spring hooking portions 160R, 160L and adjusting plates 159R, 159L fixedly secured to the right and left frames 17R, 17L so that the holding plates 155R and 155L are urged upwardly in FIG. 15. The adjusting method of the adjusting plates 159R and 159L is similar to that of the above-mentioned adjusting plates l43R and 143L.

Figure 23:
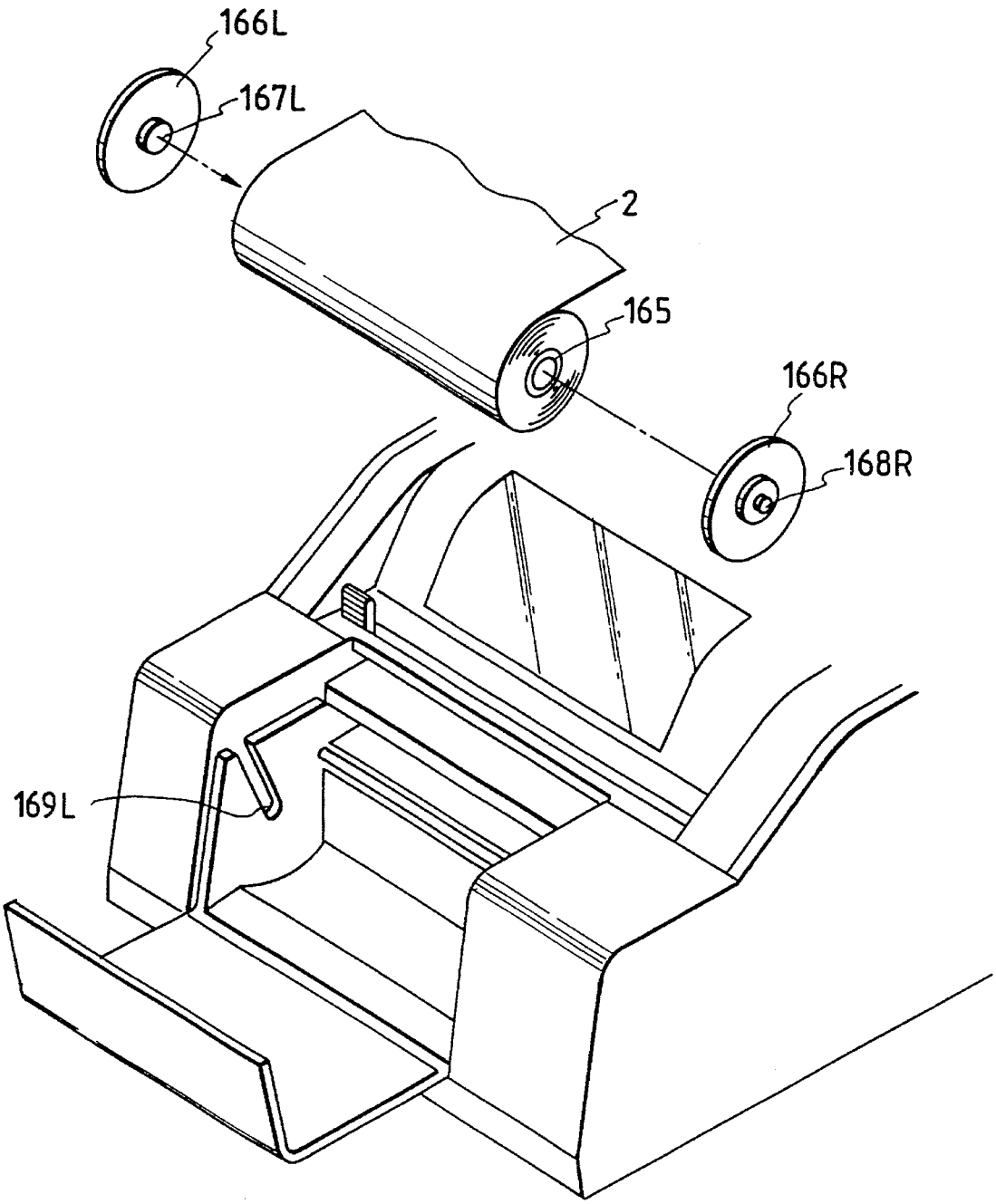
FIG. 23 shows a mounting state of a rolled recording sheet to be used in the printer according to the first embodiment.

Further, a description will be made hereinbelow with reference to FIG. 4 and 23 in terms of a method of holding the rolled recording sheet 2. The recording sheet 2 is wound around a cylindrical core so that the recording surface is at the inside so as to prevent fingerprints, dust and others from being attached thereto. For mounting the rolled recording sheet 2 on the printer 1, flanges 166R and 166L are fitted in both ends of the recording sheet core 165. The flanges 166R and 166L have on one surface, projections 167R and 167L which are fitted in the hollow of the core 165, and further have on the other surfaces shaft portions 168R and 168L which respectively project toward the outside. On the other hand, (in/on) both side walls of the recording sheet encasing section 3 there are formed U-shaped grooves 169R and 169L with which the shaft portions 168R and 168L of the flanges 166R and 166L are engaged. Thus, for mounting the rolled recording sheet 2, the rolled recording sheet 2 is dropped along the U-shaped grooves 169R and 169L after the shaft portions 168R and 168L of the flanges 166R and 166L are engaged with the U-shaped grooves 169R and 169L.

Figure 22:
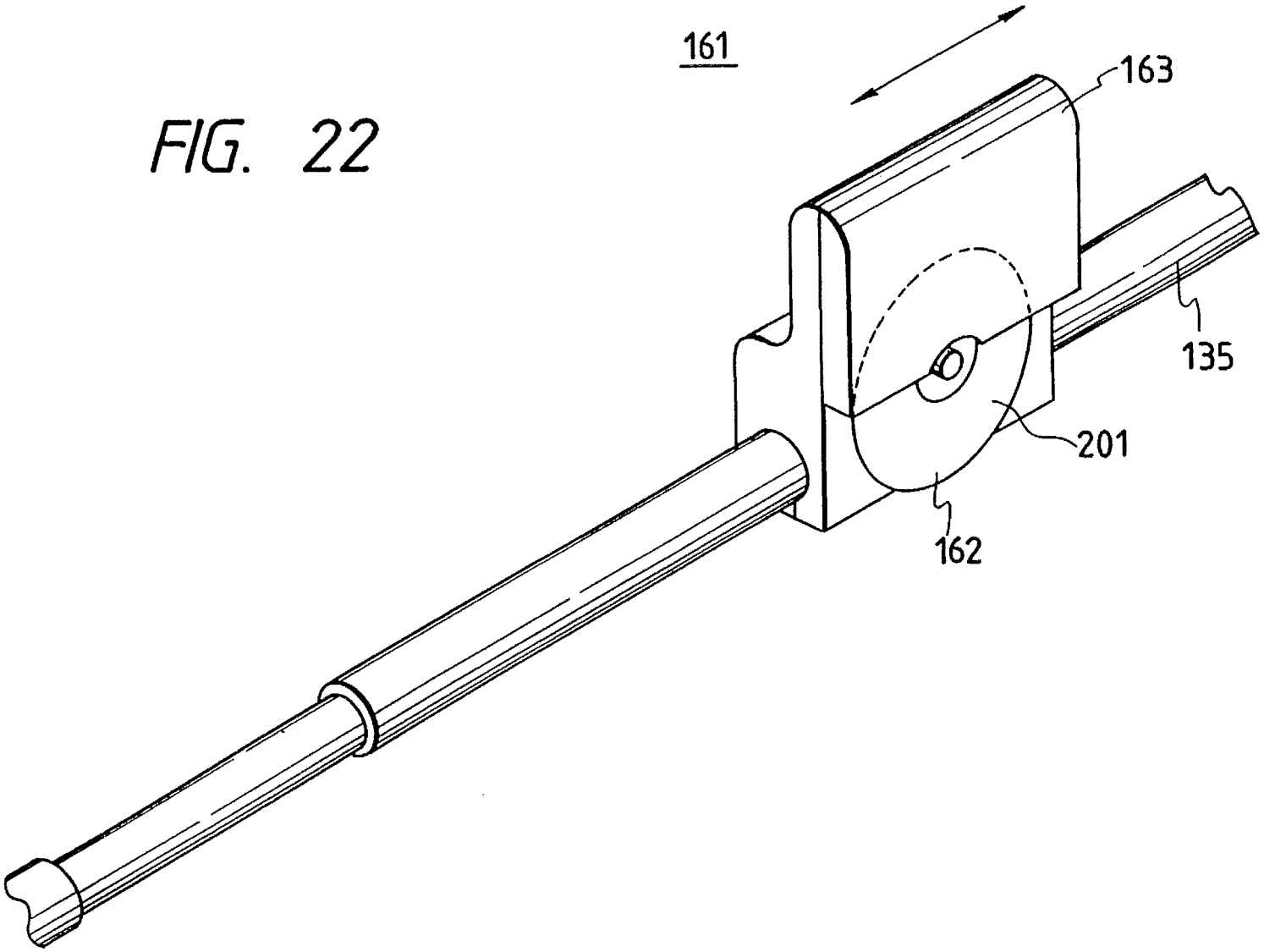
FIG. 22 is a perspective view showing a cutter section of the printer according to the first embodiment.

Further, a description will be made hereinbelow in terms of a method of drawing out the recording sheet 2 wound around the core 165 to mount it on the platen roller 7. This mounting operation is affected in the state that the thermal head mechanism section 10 takes the retreating state as illustrated in FIG. 9, and the cartridge 12 is removed and the set levers 137R and 137L take the counterclockwise rotated positions. After the rolled recording sheet 2 is mounted on the printer 1 as described above, the front portion of the recording sheet 2 is drawn out to be inserted into between the reversing roller 129 and the non-driven roller 130. At this time, since the recording sheet 2 is guided by guides 170 and 171, it is possible to easily inserting the recording sheet 2 therebetween. The front portion of the recording sheet 2 inserted between the reversing roller 129 and the non-driven roller 130 is guided by the guide 170 to pass through a gap between the guide member 170 and the platen roller 7 to be discharged toward the cartridge mounting section side. In this state, the recording sheet 2 is drawn out by hands and wound around the platen roller 7 to be inserted into between the clamping roller 82 and the drive roller 173. In this state, the set levers 137 is rotated clockwise so that the clamping roller 82 and the non-driven roller 173 take the contacting state and the reversing roller 129 and the non-driven roller 130 take the contacting state. At this time, a cutter 161 is operated to cut the front portion of the recording sheet 2 to remove the looseness and stain generated when mounting the recording sheet 2. A guide plate 175 having on its surface an elastic member is provided at the cutting portion so as to make easy the cutting operation and lengthen the life of a rotational blade 162 (FIG. 22) of the cutter 161. The guide plate 175 extends from the clamping roller 82 to the vicinity of the platen roller 7 and has at its tip portion a reflection type optical sensor 176 to detect the state of the recording sheet 2 in the staying section 14. Here, designated at numeral 177 is a reflection type optical sensor provided on the guide 170 and at a position corresponding to the left edge of the recording sheet 2 for detecting the end portion of the recording sheet 2. Further, designated at numeral 198 is an optical sensor provided at a position opposed to the reflection type optical sensor 177 in the width directions of the recording sheet 2 for detecting an OHP recording sheet. In addition, denoted at numeral 199 is a guide roller rotatably supported by the right and left frames 17R and 17L.

Figure 27:
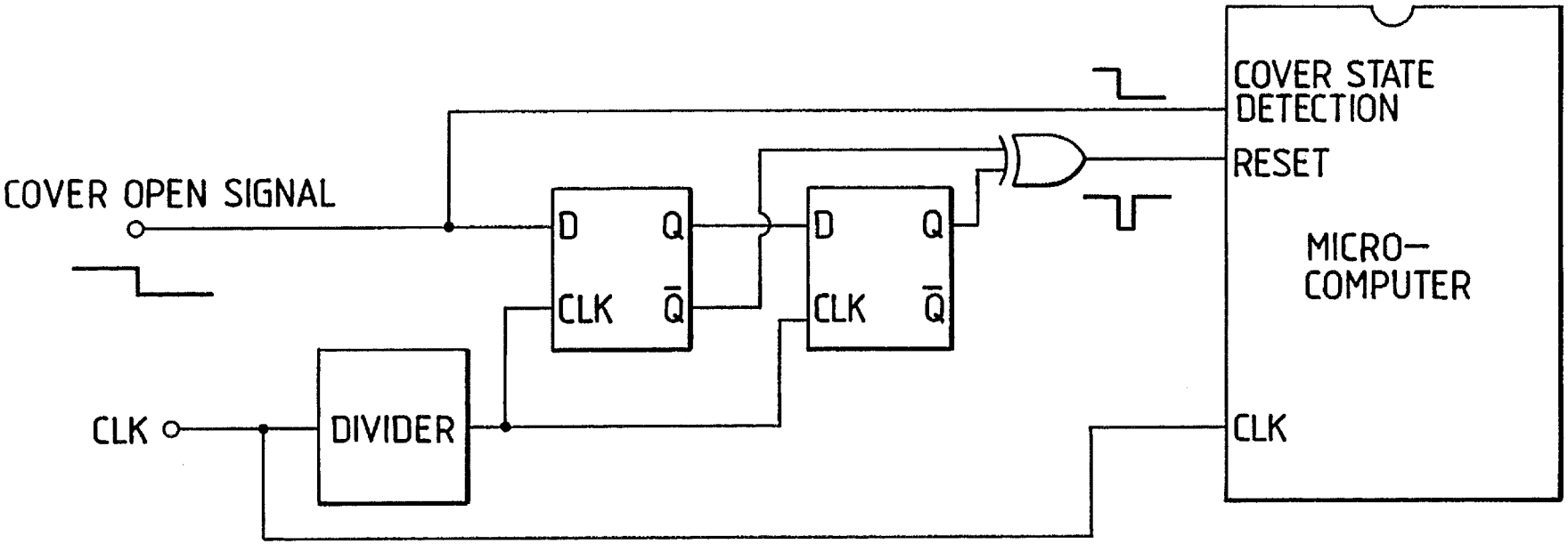
FIG. 27 is a block diagram showing a circuit for controlling the printer according to the first embodiment.
Figure 30:
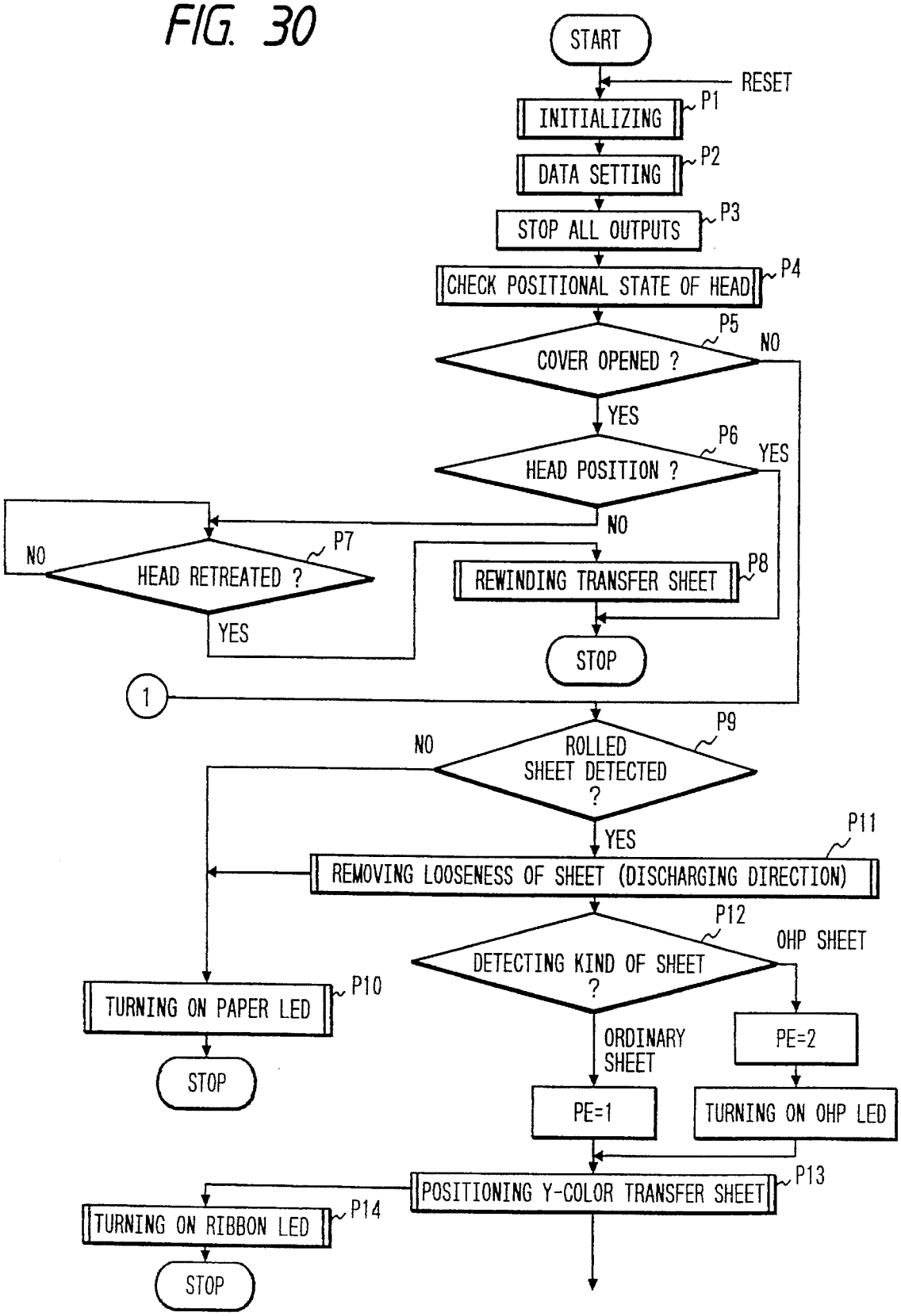
FIGS. 30 to 32 are flow charts showing a control procedure of the printer according to the first embodiment.
Figure 31:
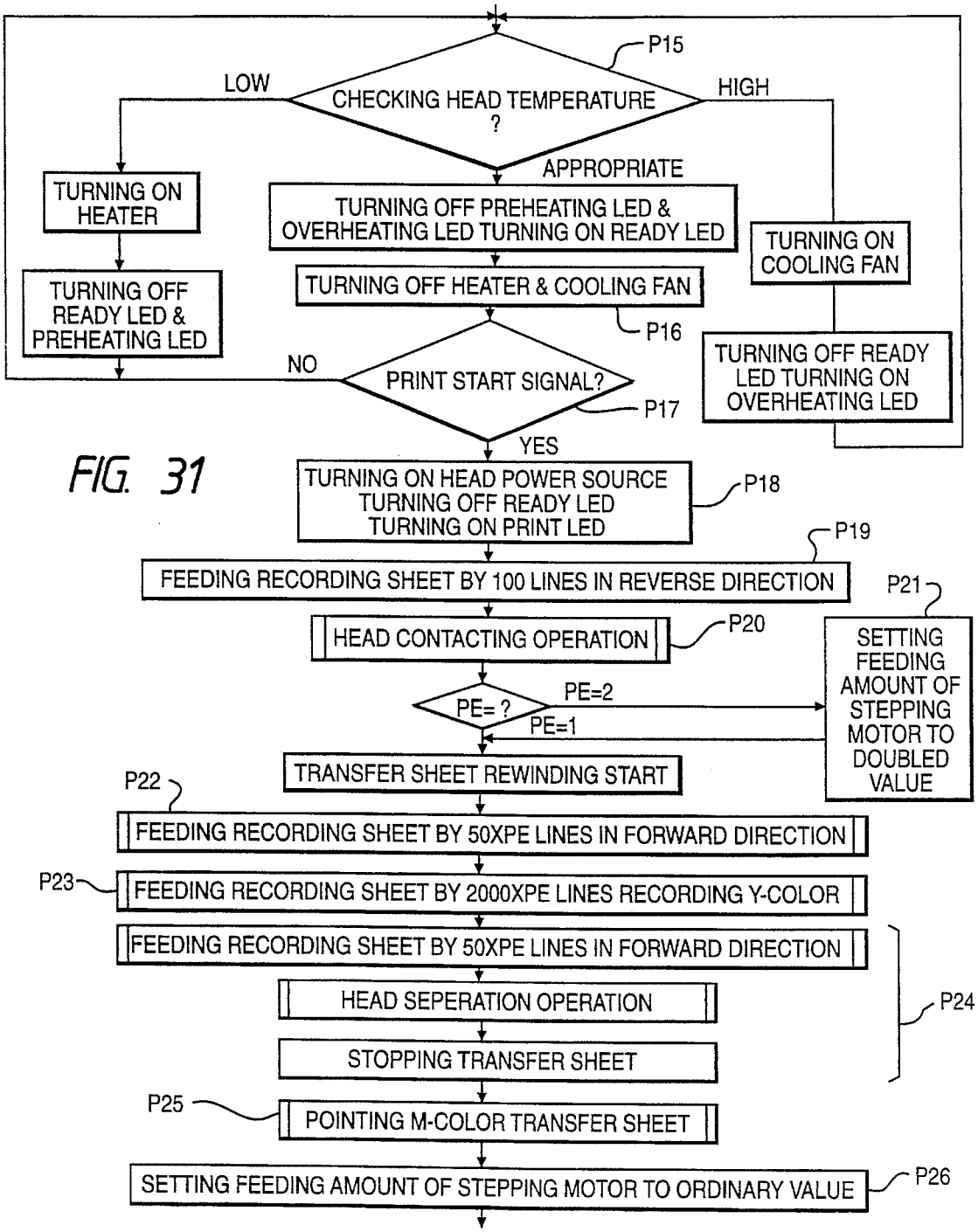
Figure 32:
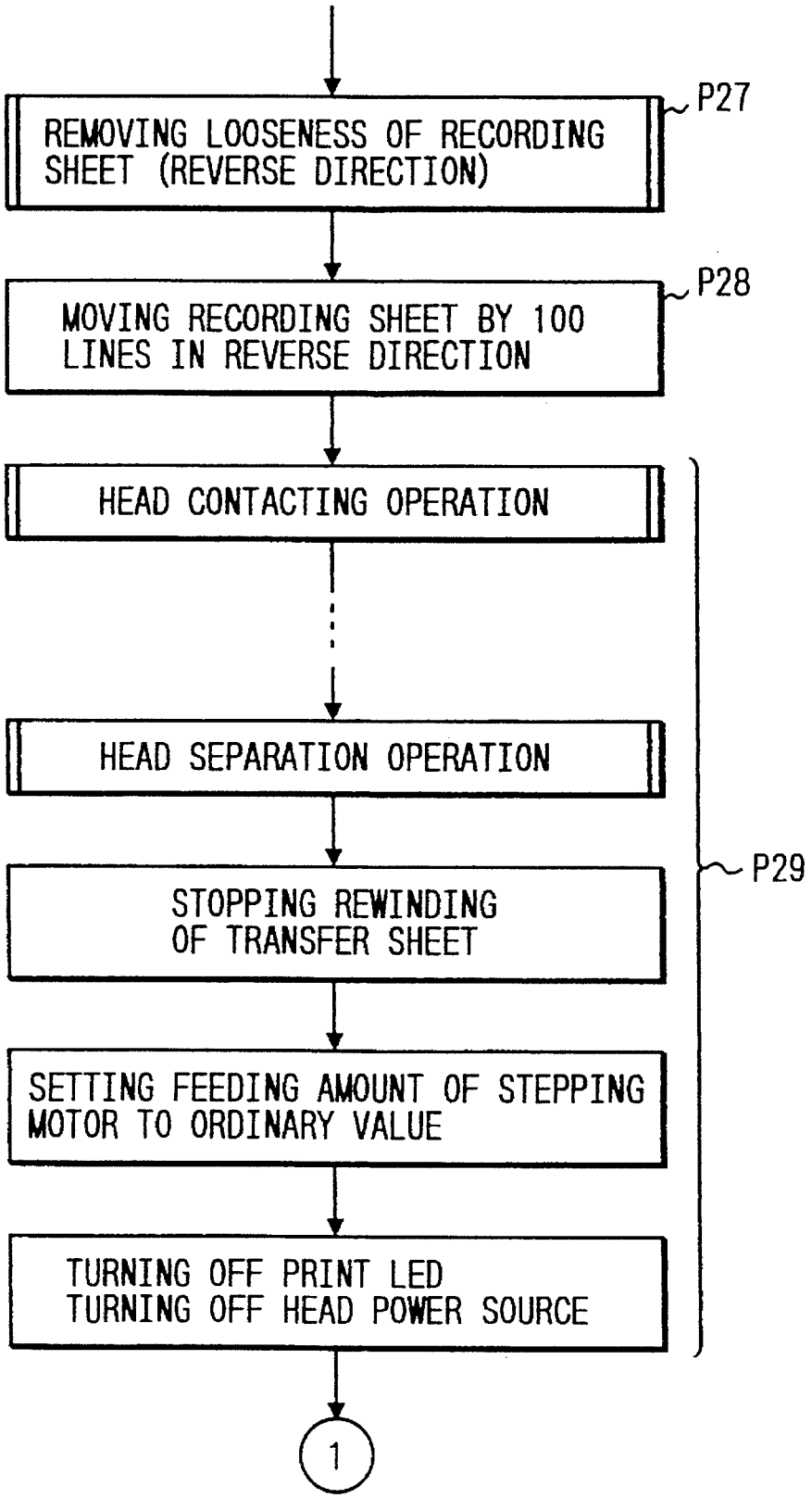

Moreover, a recording operation will be described hereinbelow with reference to flow charts of FIGS. 30 to 32. In response to turning-ON of the power source or input of a reset signal, the flow chart operation starts. As the reset signal there is a pulse signal produced on the basis of the signals from a reset button (not shown) on the printer 1 and a switch 196 of the cover 16. For example, as illustrated in FIG. 27, an inverted Q signal delayed by one clock and a Q signal delayed by two clocks are outputted from a flip-flop circuit and supplied to an exclusive OR circuit to produce a pulse signal which is in turn used as the reset signal. Here, the two-step structure of the flip-flop circuit is for coping with noises on a cover OPEN signal. Further, this cover OPEN signal is additionally used as an input signal to a microcomputer to detect the cover opening and closing state. The reset pulse signal is required to have a low-state period longer by more than several microcomputer clocks and hence a divider is used to produce a clock signal delayed. In response to the reset input, initialization is affected in the microcomputer (step P1), and various data settings to a head energization circuit, I/F circuit and others are affected (step P2). Then, all outputs such as motors, a thermal head power source and indication LEDs are stopped (step P3). This is for ensuring the safety of the printer 1 because the operating states of the mechanism systems and signal systems are not known at the time of the reset signal input. Further, the positional state of the thermal head 91 is checked (step P4). In the case that power failure occurs before the reset or in the case that the reset signal is inputted during recording, the thermal head 91 is kept in the contacting state with the platen roller 7. As described above, the contact and separation of the thermal head 91 with and from the platen roller 7 is performed by the motor 62, while, in the case that the thermal head 91 stops in the state that it contacts with the platen roller 7 and the contacting state continues for a long time, there is the possibility that the platen roller 7 is deformed and the thermal head 91 is damaged. Thus, if the pressure cam 72 takes the contact position B or the intermediate position, the pressure cam 72 is rotated up to the separation position A. Here, if the pressure cam 72 is at the separation position A from the first time, such a rotating operation of the pressure cam 72 is not required.

Thereafter, the state of the cover 16 is checked (step P5). In the case that the cover 16 is closed, the control advances to a preparation (step P9 and following steps), while, when the reset is made in the state that the cover 16 is in the open state, a preparation for removing and mounting the cartridge 12 is made (step P6). That is, the positional state of the thermal head mechanism section 10 is checked. If the thermal head mechanism section 10 is already in the retreating state, it is estimated as the cartridge 12 has already been removed, and therefore the control is affected to take a waiting state (a stopping state) for the next reset signal (the reset is again made in response to closing the cover 16). If the thermal head mechanism section 10 is in the set state, the control is affected to wait until the retreating operation of the thermal head mechanism section 10 is completed and the switch 197 becomes the OFF state (step P7). Here, even if the cover 16 is closed without the retreating operation, the reset is again made. If the retreating operation is affected, the motor 74 is rotated to rewind the transfer sheet 11 for a predetermined time period (step P8). This is because the travelling path of the transfer sheet 11 becomes shorter due to the retreating of the thermal head mechanism section 10 so that the transfer sheet 11 is loosened. That is, it is possible to prevent the transfer sheet 11 from being cut or wrinkled in removing and mounting the cartridge 12. In addition, with the transfer sheet 11 being re-wound, it is possible to prevent a portion of the transfer sheet 11 corresponding to one picture from being wasted even if the cartridge 12 is mounted or removed in a state that the yellow ink portion of the transfer sheet 11 is headed. Moreover, it is possible to prevent dust from being attached to the unused transfer sheet 11 at the time of the removal and mounting of the cartridge 12.

After the removal and mounting of the cartridge 12, if the thermal head mechanism section 10 is again set to the set state and the cover is closed, the reset signal is inputted to again start the program. When the thermal head mechanism section 10 is kept to the retreating state, the cover 16 cannot be closed as described above. Further, even if the setting operation of the thermal head mechanism section 10 or the closing operation of the cover 16 is affected without setting the cartridge 12, as will be described hereinafter, an error signal is generated at the time of the yellow ink portion heading operation so as to stop the operation of the printer 1.

Figure 28:
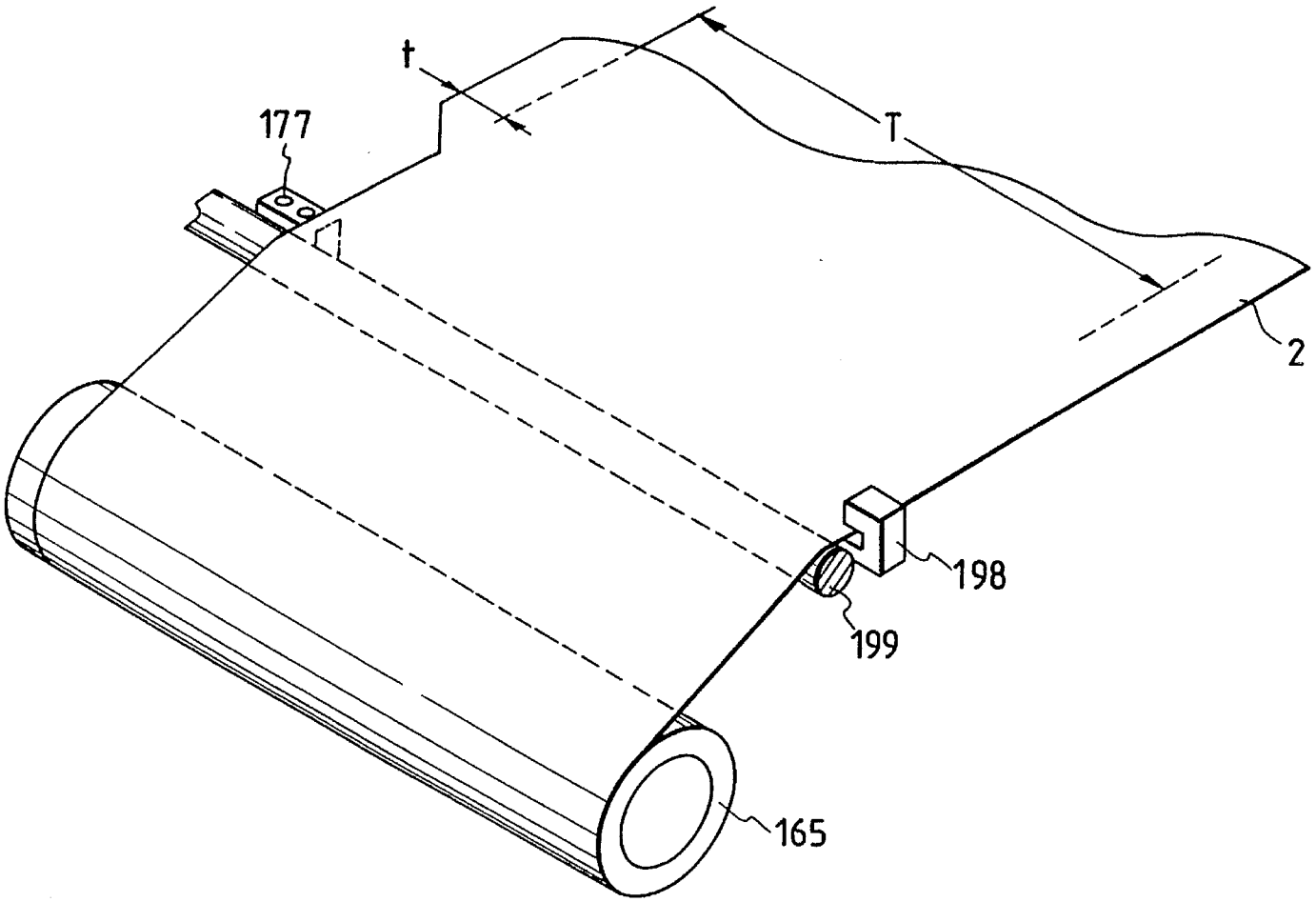
FIG. 28 shows a method of detecting a recording sheet in the printer according to the first embodiment.

When the cover 16 is closed, it is checked whether or not the next recording sheet 2 exists (step P9). As described above, the presence of the recording sheet 2 is detected by the reflection type optical sensor 177 provided on the guide 170. Here, as shown in FIG. 28, the end portion of the rolled recording sheet 2 has a width reduced by t throughout a length corresponding to one picture. Thus, when reaching the width-reduced portion of the recording sheet 2, the light emitted from the reflection type optical sensor 177 is not reflected whereby it is possible to detect that the recording sheet 2 is shortly ended. Further, since the width of the recording sheet 2 necessary for forming a picture is T in FIG. 28, even if the width-reduced portion of the recording sheet 2 is detected on the way of recording the yellow ink, it is possible to normally and completely record that picture without wasting. When the recording sheet 2 is ended, a paper LED is turned ON to stop the printing operation (step P10).

Further, the recording sheet 2 in the staying section 14 is checked. Since the recording sheet 2 is stayed in the staying section 14 during the energization operation, when the reset signal is inputted, the recording sheet 2 corresponding to one picture is required to be discharged. The state that the recording sheet 2 stays in the staying section 14 is as shown in FIG. 7. The recording sheet 2 is curved to form a loop configuration and takes a position separated from the reflection type optical sensor 176 whereby the reflection type optical sensor 176 does not receive the reflected light therefrom. That is, it is possible to detect that the recording sheet 2 takes the curved state and stays within the staying section 14. Thus, in this case, the motor 74 is driven to reduce the amount of the loop of the recording sheet 2, and the recording sheet 2 stored in the clamping roller 82, is discharged until the reflection type optical sensor 176 detects the reflection light. At this time, the time from the discharging start to the detection of the reflection light is counted to substantially obtain the discharged amount of the recording sheet 2 on the basis of the counted time and the peripheral velocity of the clamping roller 82, so that the remaining amount of the recording sheet 2 corresponding to one picture is calculated as the number of pulses for rotationally driving the stepping motor 115 on the basis of the discharged amount obtained. Thereafter, the stepping motor 115 and the clamping roller 82 are simultaneously rotational-driven to further discharge the recording sheet 2 (step P11). Here, in the case that the reflection type optical sensor 176 does not detect the reflection light even if the clamping roller 82 is rotational-driven for above a predetermined time period, a decision is made such that the recording sheet 2 is not normally set and hence the paper LED is turned to stop the operation (step P10). Further, when the reflection type optical sensor 176 detects the reflection light from the first time, a decision is made such that the looseness does not occur and the control advances to the next process. Then, it is checked whether the recording sheet 2 is the ordinary sheet or the OHP sheet (step P12). This detection is affected by the transmission type optical sensor 198 (FIG. 28) provided at a position corresponding to an edge portion of the recording sheet 2. That is, when the light transmits the recording sheet 2, the recording sheet 2 is decided as the OHP sheet, and when not transmitting the recording sheet 2, the recording sheet 2 is considered as the ordinary sheet. In the case of the OHP sheet, it is required to increase the recording density. Accordingly, the recording density in the secondary scanning directions is doubled and the same data is recorded two times. In response to the OHP sheet being decided, a variable PE is set to 2 and an OHP LED is turned on. On the other hand, in the case of the ordinary sheet, the variable PE is set to 1.

Still further, the yellow ink heading operation of the transfer sheet 11 is affected (step 13). This heading operation is performed by the above-mentioned light sources 152R, 152L and light-receiving devices 153R, 153L. Since the inks on the transfer sheet 11 are successively applied in order of yellow, magenta and cyan, the transfer sheet 11 is wound by the motor 62 until the cyan ink is detected. Here, if the previous recording is normally completed, the cyan ink is immediately detected. Thereafter, the transfer sheet 11 is further wound until the yellow ink is detected and the motor 62 is stopped in response to the detection of the yellow ink. Here, when the cyan ink or the yellow ink is not detected even if the transfer sheet 11 is wound for a predetermined time period, a decision is made such that the transfer sheet 11 is ended or cut, thus turning on a ribbon LED to stop the printer 1.

Moreover, the temperature of the thermal head 91 is detected (step P15). Generally, in a thermal printer similar to this invention, the temperature of the thermal head can easily affect the recording density. That is, since the recording density is lowered at the start time of the energization when the ambient temperature is low, the thermal head is heated by a heater so that the temperature of the entire thermal head is increased to above the ordinary temperature before recording. On the other hand, in the case of the continuous recording, since the temperature of the entire thermal head increases to heighten the recording density, the thermal head is required to be cooled by a fan or the like. In this embodiment, a temperature-measuring element such as a thermistor is built in the thermal head 91. If the temperature detected by this temperature-measuring element is below a predetermined value, a heater is turned ON and a preheat LED is turned ON. If it is above the predetermined value, a cooling fan is turned ON and an overheat LED is turned ON. Further, when it reaches the predetermined temperature (range), the heater or fan is turned OFF, and the preheat LED or overheat LED is turned OFF, and further a ready LED is turned ON (step P16). At this time, the printer 1 takes the waiting state for the printing start signal (step P17). If the temperature of the thermal head 91 varies, the ready LED is turned OFF and the above-described processes are repeatedly affected.

In response to the printing start signal, the ready LED is turned OFF, a print LED is turned ON and the thermal head power source is turned ON (step P18). First, the recording sheet 2 is rotated in the reverse direction (step P19). This is because, although the recording sheet 2 in the staying section 14 has already been stretched to some degree which allows the detection by the reflection type optical sensor 176, the recording sheet is not completely stretched. This stretching operation of the recording sheet 2 is affected with the stepping motor 115 being rotated in the reverse direction and the recording sheet 2 being held between the reversing roller 129 and the non-driven roller 130 and drawn. Thus, the recording sheet 2 becomes in a state that is disposed along the tangential line of the circumference of the clamping roller 82 and the circumference of the platen roller 7. Here, the drawing direction of the recording sheet 2 is the direction that the rotation of the clamping roller 82 is restricted by the one-way clutches 40R and 40L, and therefore the clamping roller 82 does not rotate. Further, the platen roller 7 is in the slipping state due to the one-way clutch 124 so as not to rotate, while the stepping motor is rotated by an amount corresponding to 100 lines to remove the slack of the recording sheet 2. Here, it is appropriate that the stepping motor 115 is controlled by a timer so as to be rotated for a predetermined time period. After the looseness is completely removed, the recording sheet 2 stops whereby the reversing roller 129 slips with respect to the recording sheet 2. Since the reversing roller 129 is brought into contact with the back surface of the recording sheet 2, the recording quality can be prevented from being deteriorated due to the slipping.

Figure 29:
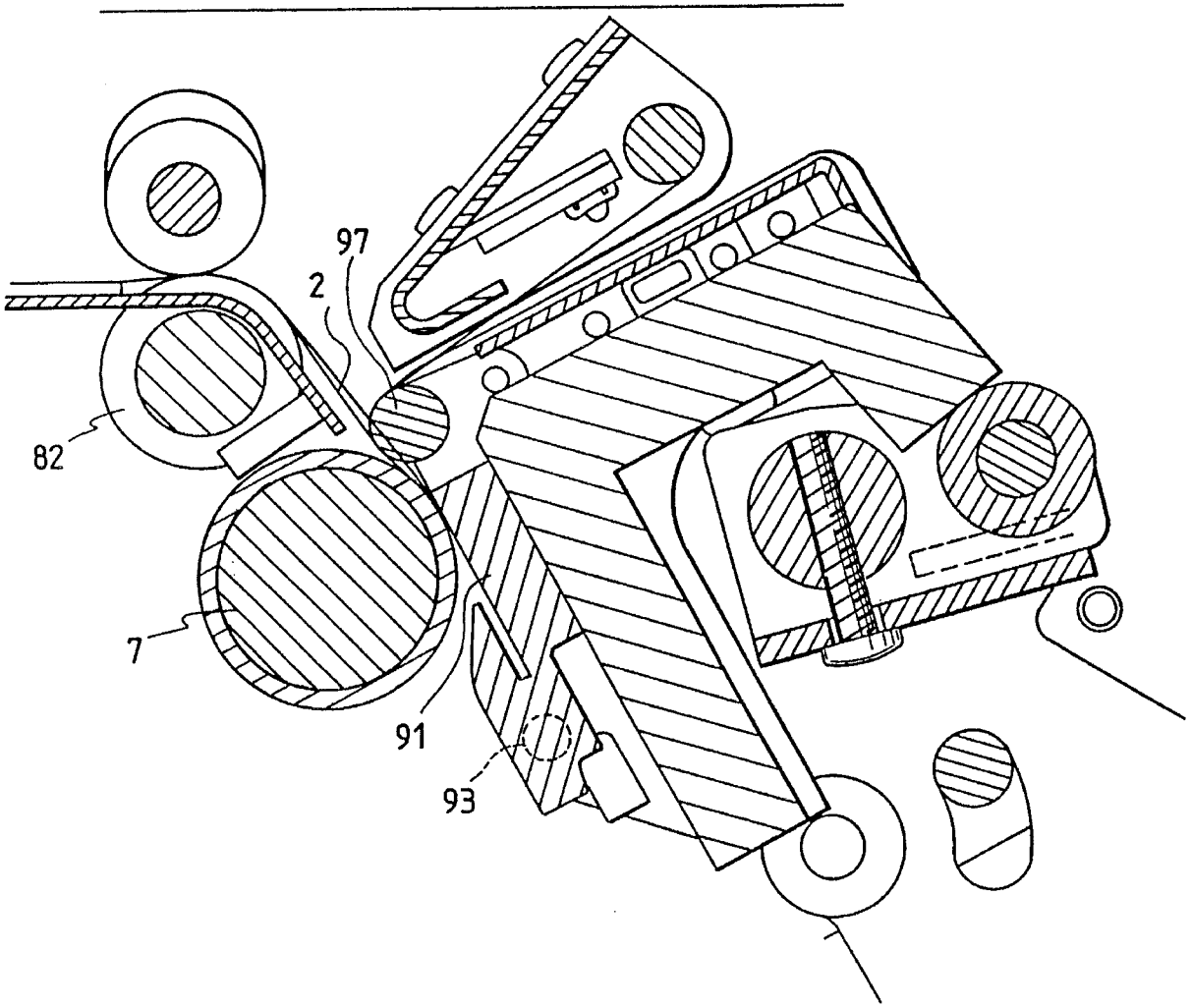
FIG. 29 is an enlarged cross-sectional view showing the thermal head mechanism section of the printer according to the first embodiment.

Further, the thermal head 91 comes into contact with the platen roller 7 to press it (step P20). As well as the separation operation, this operation is affected with the motor 62 being rotated until the optical sensors 109 and 110 detect the contacting position B. When the thermal head 91 is brought into contact with the platen roller 7, as described above the transfer sheet guide roller 97 enters into the inside of the tangential line of the clamping roller 82 and the platen roller 7. Thus, the slack-removed recording sheet 2 is supported on the clamping roller 82, the transfer sheet guide roller 97 and the platen roller 7 (FIG. 29). Due to this operation, it is possible to remove the slight slack of the recording sheet 2 which has not been removed by the previously affected reversal movement of the recording sheet 2 corresponding to 100 lines. Here, if the slack of the recording sheet 2 is completely removed by the reversal movement, the platen roller 7 is forced to be rotated counterclockwise in FIG. 29 and easily rotated by the one-way clutch 124 so that the recording sheet 2 is fed between the platen roller 7 and the reversing roller 129 to prevent the clamping roller 82 side recording sheet 2 from being shifted. Since as described above, the looseness of the recording sheet 2 can sufficiently be removed by the two removing operations, it is possible to prevent the positional shifting of the recording sheet 2 to provide a high-quality image.

Here, the drive of the pressure cam 72 and the take-up of the transfer sheet 11 are affected by the same motor 62 as described above, and therefore the gear 66 rotates clockwise at the time of the contacting operation of the thermal head 91 with the platen roller 7 so that the take-up roll 26 of the transfer sheet 26 rotates clockwise to generate the looseness of the transfer sheet 11. If this looseness occurs at the vicinity of the thermal head 91, there is the possibility that the transfer sheet 11 is wrinkled during the recording. However, since as described above, the guide roller 31 is arranged to be rotated in the direction opposite to the take-up roll 26 in conveying the transfer sheet 11, the looseness occurs only between the guide roller 31 and the take-up roll 26, thus preventing a trouble due to the looseness. The looseness of the transfer sheet 11 generated thereat is quickly taken by the take-up roll 26 through the transfer sheet take-up operation which will be performed later. In addition, although the transfer sheet is also loosened at the time of the operation in which the thermal head 91 is separated from the platen roller 7, this looseness is taken by the take-up roll 26 through the transfer sheet heading operation which will be performed later.

Thereafter, the variable PE is read to set the forward feeding amount of the stepping motor 115 on the basis of the value of the variable PE (step P21). That is, if the recording sheet 2 is the ordinary sheet, the feeding amount is set to obtain the ordinary density, and if it is the OHP sheet, the feeding amount is set to obtain the density doubled. Then, the transfer sheet winding motor 62 is turned ON and the recording sheet is merely fed in the forward direction by an amount corresponding to 50 lines if being the ordinary sheet and fed by an amount corresponding to 100 lines if being the OHP sheet, before starting the energization of the thermal head 91 (step P22). Further, for the recording, the energization is affected with respect to the portion of the recording sheet corresponding to 2000 lines if being the ordinary sheet and affected with respect to the portion thereof corresponding to 4000 lines if being the OHP sheet, before the recording sheet 2 was merely fed by an amount corresponding to 50 lines if being the ordinary sheet and by an amount corresponding to 100 lines if being the OHP sheet (step P23). Here, since the tip portion of the recording sheet 2 is fixed by the clamping roller 82 at this time, the recorded portion of the recording sheet 2 is successively stored in the staying section 14 as shown in FIG. 7. Further, the transfer sheet 11 is separated from the recording sheet 2 by the transfer sheet guide roller 97 and taken by the take-up roll 26. As described above, the recording sheet 2 in the stay section 14 can be observed through the transparent portion 41 of the cover 16. Further, the cover 16 can prevent dust from being attached to the recording sheet 2.

Then, processes similar to the aforementioned processes are affected (step P24). That is, the thermal head 91 is separated from the platen roller 7 and the motor 62 is stopped. At this time, since the portion of the transfer sheet 11 taking opposed relation to the platen roller 7 is only in the yellow ink printed state, the transfer sheet 11 is wound by the take-up roll 26 to be positioned for the magenta ink printing (step P25). Thereafter, the forward feeding amount of the stepping motor 115 is set to the value for the ordinary sheet (step P26) and the recording sheet stayed in the staying section 14 is fed in the reverse direction until the reflection type optical sensor 176 detects the reflected light from the recording sheet 2 (step P27). Here, since the feeding amount of the stepping motor 115 is set to the value for the ordinary sheet, it is possible to reduce the time necessary for the reversal feeding if the recording sheet 2 is the OHP sheet.

Similarly, after the detection of the reflected light from the recording sheet 2 by the reflection type optical sensor 176, the recording sheet 2 is fed in the reverse direction by an amount corresponding to 100 lines to remove the looseness of the recording sheet 2 (step P28), before similarly performing the magenta ink and cyan ink recording and turning OFF the print LED and the thermal head power source after the cyan ink recording is completed (step P29). This step P29 is followed by the step P9 to discharge the recording sheet 2 in the staying section 14 and then make a preparation for the next recording.

As described above, according to the printer of this embodiment, in feeding the recording sheet 2 in the forward and reverse directions, the looseness of the recording sheet 2 can sufficiently be removed without accurately measuring and controlling the amount of the recording sheet 2 to be fed. In addition, according to this embodiment, since there is no problem even if the backlash of the mechanism occurs in the forward and reverse feeding operation, it is possible to reduce the cost of the mechanism.

Figure 33:
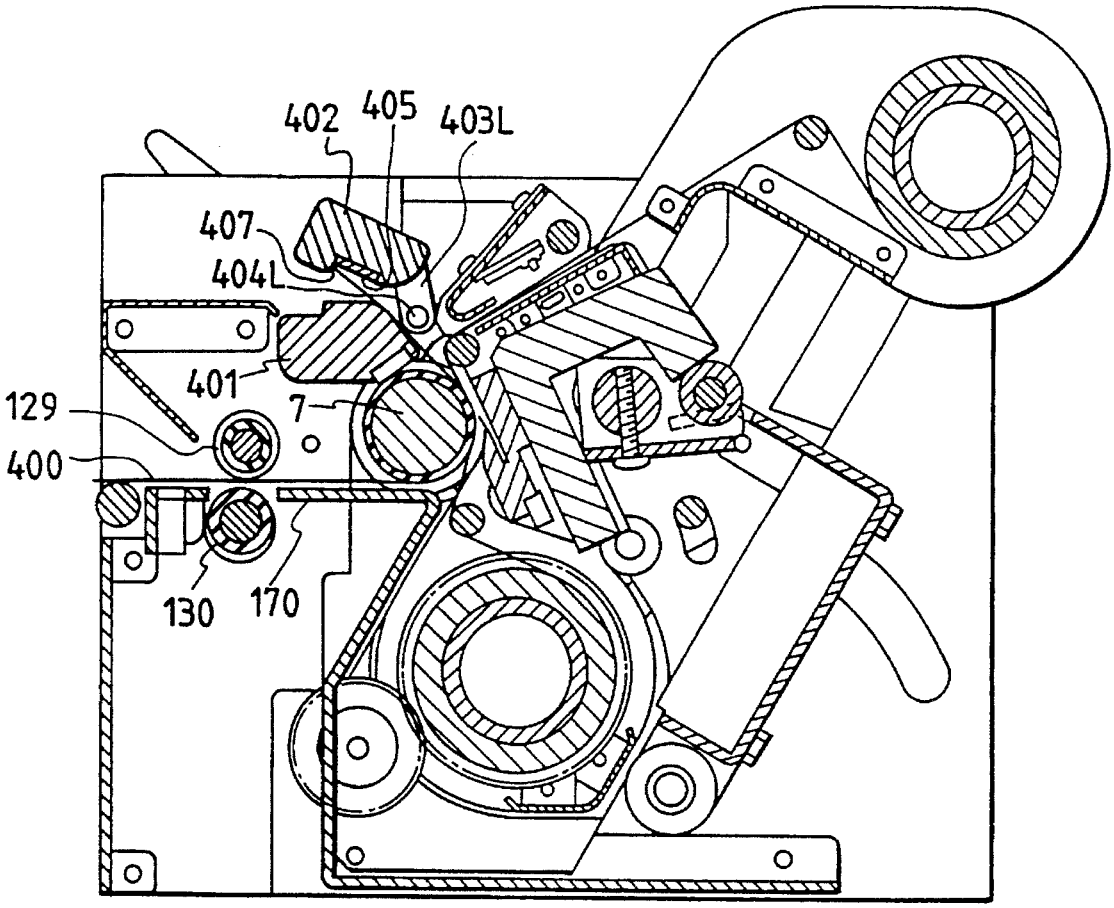
FIGS. 33 and 34 are cross-sectional views showing a mechanism section of a printer according to a second embodiment of this invention.
Figure 34:
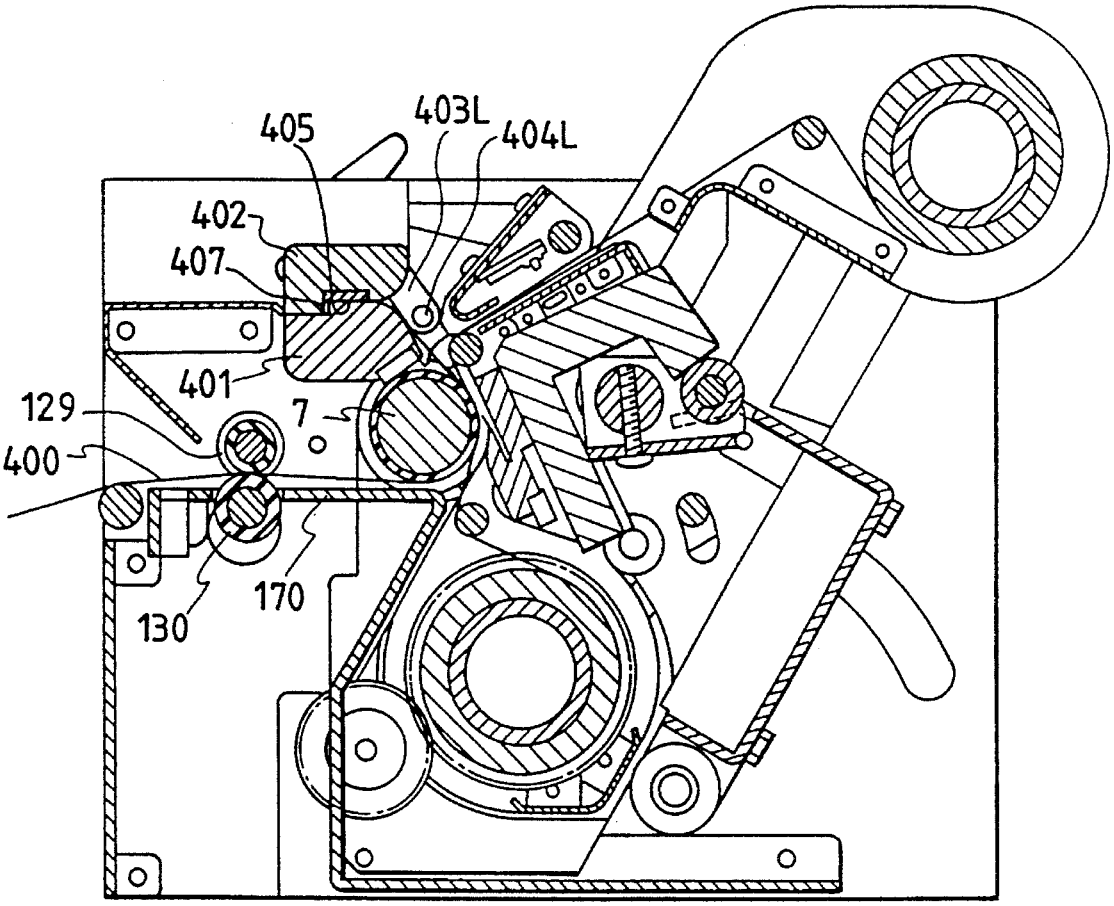
Figure 35:
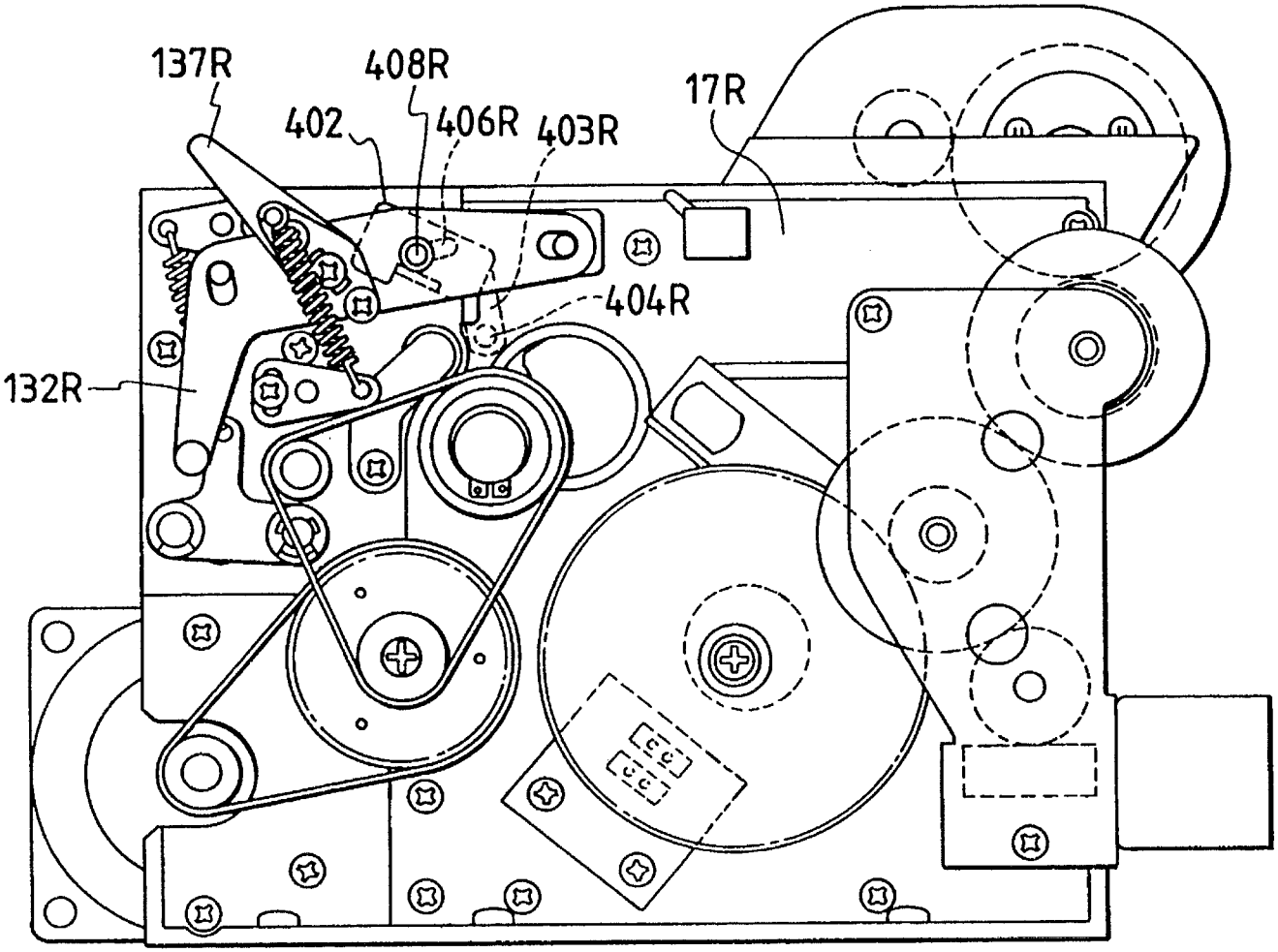
FIGS. 35 and 36 are right side views showing the mechanism section of the printer according to the second embodiment.
Figure 36:
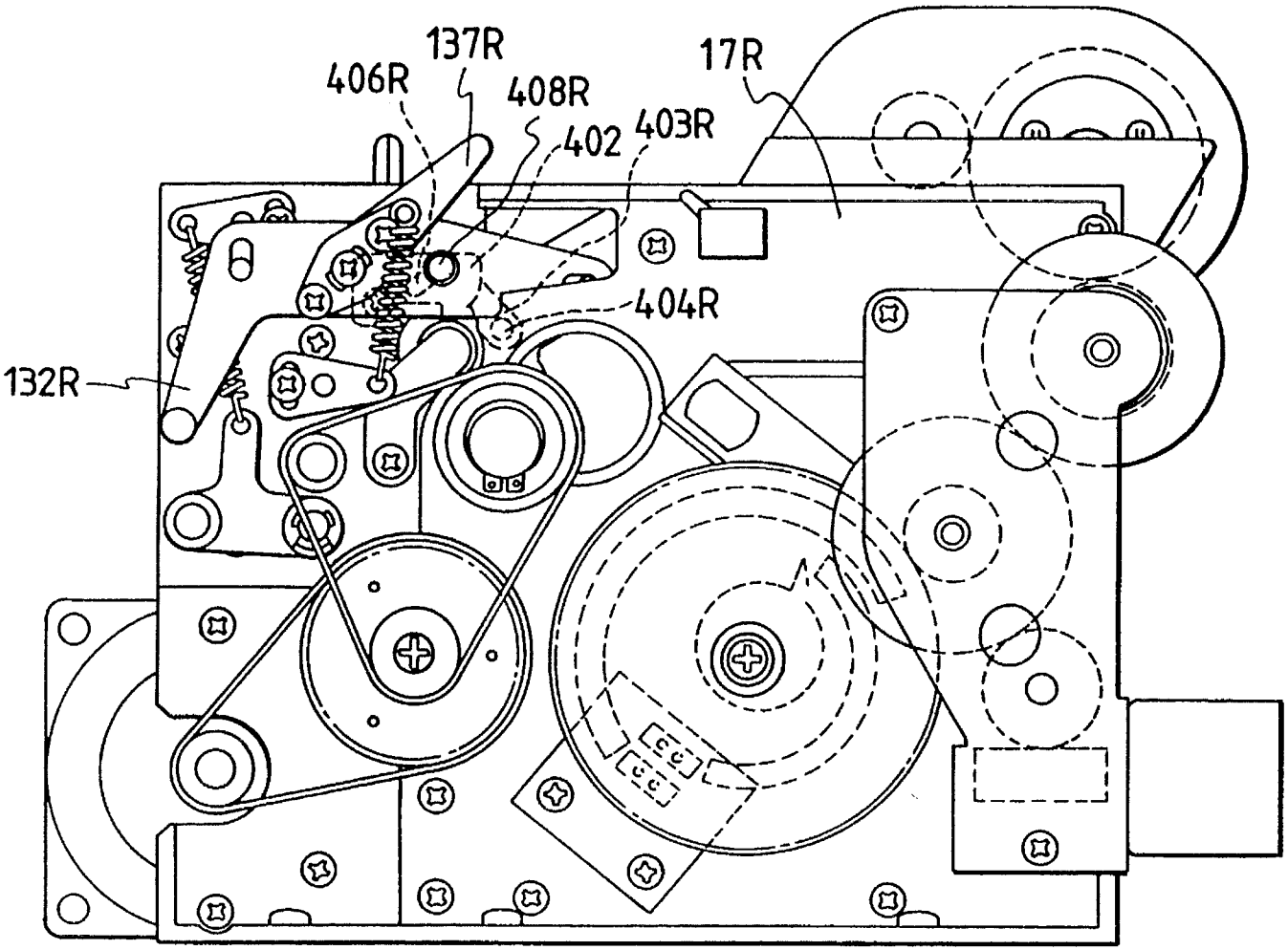

Although in the above-described embodiment a rolled recording sheet 2 is used as recording paper for printing an image and the recording sheet 2 is held and fixed by the clamping means comprising the clamping roller 82 and the drive roller 173, this invention is not limited to such a printer. For example, it is also appropriate that so-called cut sheets, cut to have a predetermined size, are used as the recording paper and supplied one by one from a sheet-feeding tray, and the front portion of the sheet supplied is held and fixed by a clamping means having a non-roller configuration. This arrangement will be described hereinbelow as a second embodiment of this invention with reference to FIGS. 33 to 36. FIGS. 33 and 34 are cross-sectional views corresponding to FIGS. 6 and 7, respectively, and FIGS. 35 and 36 are cross-sectional views corresponding to FIGS. 15 and 21, respectively. Parts which are not illustrated in FIGS. 33 to 36 are substantially similar to those of the above-described first embodiment and the description thereof will be omitted for brevity.

In this embodiment, cut sheets 400 encased within a tray, not shown, provided at the left side of the reversing roller 129 are fed by a sheet-feeding mechanism, not shown, and guided through the guide 170 to be wound around the platen roller 7, before the front portion of the cut sheet 400 is fixedly held by a clamping means comprising a fixed clamping member 401 and a movable clamping member 402 as shown in FIG. 34. Thereafter, as well as the above-described first embodiment, the cut sheet 400 is operated to reciprocate several times by the platen roller 7, reversing roller 129 and non-driven roller 130 in the state that the front portion of the cut sheet 400 is fixed by the aforementioned clamping means, thus performing the recording. Further, as well as the case as shown in FIG. 7, each color recording process alternately takes a state that the cut sheet 400 is loosen and temporarily stored in the staying section 14 and a state that the cut sheet 400 is fed in the reverse direction by the reversing roller 129 and others to remove the looseness thereof. After the recording for all the colors is completed, the cut sheet 400 is released from the clamped state due to the clamping means and discharged through a sheet-discharging mechanism, not shown, thereafter terminating the printing operation.

A detailed description will be made hereinbelow in terms of the arrangement of the clamping means. As described above, the clamping means basically comprises the fixed clamping member 401 and the movable clamping member 402. The movable clamping member 402 is made of a material having a high rigidity and arranged to have a uniform configuration over the total length of the cut sheet 400 in the width directions. On a clamping surface 405 thereof there is provided a frictional member such as rubber. Further, a stopper portion 407 is provided at a sheet-discharging opening 8 side portion of the clamping surface 405. When the clamping means takes the opening state as illustrated in FIG. 33, the front portion of the cut sheet 400 supplied from the platen roller 7 side comes into contact with the stopper portion 407 so that the inclination of the cut sheet 400 is forced. On the other hand, the fixed clamping member 401 is made of a material having a high rigidity and arranged to come into contact with the clamping surface 405 of the movable clamping member 402 throughout the total length of the cut sheet 400 in the width directions. The fixed clamping member 401 is disposed at the vicinity of the portion of the platen roller 7 at which the cut sheet 400 is not wound, and acts as a stay member for the connection between the right and left frames 17R and 17L.

Secondly, the opening and closing operation of the clamping means will be described hereinbelow. Both end portions of the movable clamping member 402 are fixed to arms 403R and 430L which are in turn rotatably supported by shafts 404R and 404L planted in the right and left frames 17R and 17L. Moreover, guide grooves 406R and 406L are formed in both the end portions of the movable clamping member 402, and, after penetrating opening portions (not shown) formed in the right and left frames 17R and 17L, pins 408R and 408L, being planted in the moving levers 132R and 132L, are engaged with the guide grooves 406R and 406L of the movable clamping member 402. Thus, the set levers 137R and 137L are rotated counterclockwise and positioned as illustrated in FIG. 35, the movable clamping member 402 rotates counterclockwise about the shafts 404R and 404L to come into contact with the fixed clamping member 401 to take the clamping state by means of the springs 138R and 138L.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A color printer, comprising:

a platen roller;

a recording head means to be brought into contact with said platen roller to record an image having at least two colors on a recording sheet interposed between said recording head means and said platen roller, said two colors being successively printed on a surface of said recording sheet with said recording sheet being operated to reciprocate with respect to a recording position on said platen roller;

clamping means provided at a downstream side of said recording head means in a sheet travelling path from a supply section of said recording sheet to a discharging section of said recording sheet for holding said recording sheet when recording said image, said clamping means being fixed with respect to said recording position so that a distance between a holding position of said recording sheet taken by said clamping means and said recording position on said platen roller is always constant during the image recording.

2. A color printer as claimed in claim 1, further comprising reversing means provided at an upstream side of said recording head means in said sheet travelling path for moving said recording sheet toward an upstream side in said sheet travelling path before the image recording.

3. A color printer as claimed in claim 2, further comprising arresting means provided between said recording head means and said clamping means for temporarily arresting said recording sheet, detection means for detecting said recording sheet arrested in said arresting means, and drive means for driving said reversing means so that said recording sheet is moved toward the upstream side in the sheet travelling path until said detection means detects an absence of said recording sheet within said arresting means, and for additionally driving said reversing means for a predetermined time period.

4. A color printer as claimed in claim 3, wherein said drive means comprises a drive motor for driving said platen roller and said reversing means, a first one-way clutch provided between said drive motor and said platen roller and a second one-way clutch provided between said drive motor and said reversing means, said first one-way clutch interrupting communication between said drive motor and said platen roller when said recording sheet moves from a downstream side in the sheet traveling path to the upstream side, and said second one-way clutch interrupting communication between said drive motor and said reversing means when said recording sheet moves from the upstream side to the downstream side.

5. A color printer as claimed in claim 2, further comprising arresting means provided between said recording head means, said clamping means for temporarily arresting said recording sheet, detection means for detecting said recording sheet arrested in said arresting means, and drive means for driving said reversing means so that said recording sheet is moved toward the upstream side in the sheet travelling path until said detection means detects an absence of said recording sheet within said arresting means, and for additionally driving said reversing means to cause said recording sheet to move by a predetermined distance.

6. A color printer as claimed in claim 5, wherein said drive means comprises a drive motor for driving said platen roller and said reversing means, a first one-way clutch provided between said drive motor and said platen roller and a second one-way clutch provided between said drive motor and said reversing means, said first one-way clutch interrupting communication between said drive motor and said platen roller when said recording sheet moves from a downstream side in the sheet travelling path to the upstream side, and said second one-way clutch interrupting communication between said drive motor and said reversing means when said recording sheet moves from the upstream side to the downstream side.

7. A color printer as claimed in claim 2, further comprising roller means integrally attached to said recording head means, said roller means coming into contact with said recording sheet stretched between said clamping means and said platen roller when said recording head means is brought into contact with said platen roller so that said recording sheet is deformed to remove a slack of said recording sheet.

8. A color printer as claimed in claim 1, wherein said clamping means comprises two rollers for holding said recording sheet therebetween, one of said two rollers not being driven while the other roller being rotatably driven by a motor.

9. A color printer as claimed in claim 1, wherein said clamping means comprises two plates for holding said recording sheet therebetween, one of said two plates being fixed while the other of said plates being arranged to be movable to come into contact with said one plate.

10. A color printer as claimed in claim 1, wherein said clamping means comprises roller means arranged to be rotatable only in one direction to discharge said recording sheet toward said discharging section after the image is recorded on said recording sheet.

11. A color printer, comprising:

a platen roller;

a recording head means to be brought into contact with said platen roller to record an image having at least two colors on a recording sheet interposed between said recording head means and said platen roller, said two colors being successively printed on a surface of said recording sheet with said recording sheet being operated to reciprocate with respect to a recording position on said platen roller;

clamping means provided at a downstream side of said recording head means in a sheet travelling path from a supply section of said recording sheet to a discharging section of said recording sheet for continuously clamping a leading edge of said recording sheet against a reciprocating movement of said recording sheet until successive printing operations of plural colors of said image are completely finished, said clamping means being fixed with respect to said recording position so that a distance between a clamping position of said recording sheet taken by said clamping means and said recording position on said platen roller is always constant during the image recording.

* * * * *